US006755513B1

(12) United States Patent
Silverbrook et al.

(10) Patent No.: US 6,755,513 B1
(45) Date of Patent: Jun. 29, 2004

(54) PRINTHEAD SUPPORT STRUCTURE AND ASSEMBLY

(75) Inventors: Kia Silverbrook, Balmain (AU); Tobin Allen King, Cremorne (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 09/609,140

(22) Filed: Jun. 30, 2000

(30) Foreign Application Priority Data

Jun. 30, 1999 (AU) ..... PQ1304
Jun. 30, 1999 (AU) ..... PQ1305
Jun. 30, 1999 (AU) ..... PQ1306

(51) Int. Cl.[7] ..... B41J 2/175
(52) U.S. Cl. ..... 347/85
(58) Field of Search ..... 347/40, 42, 44, 347/49, 65, 85, 86, 87

(56) References Cited

U.S. PATENT DOCUMENTS 5,565,900 A * 10/1996 Cowger et al. ..... 347/42
5,668,583 A 9/1997 Thiel et al.
5,696,544 A * 12/1997 Komuro ..... 347/50
6,244,696 B1 * 6/2001 Tran et al. ..... 347/87
6,318,849 B1 * 11/2001 Silverbrook ..... 347/85
6,641,253 B2 * 11/2003 Silverbrook et al. ..... 347/42
2003/0090541 A1 * 5/2003 Silverbrook et al. ..... 347/49

FOREIGN PATENT DOCUMENTS

EP 0666174 A2 8/1995
EP 0811497 A 12/1997
EP 0822078 A 2/1998
EP 0838339 A 4/1998

* cited by examiner

*Primary Examiner*—Michael Nghiem

(57) ABSTRACT

An inkjet printhead assembly (1) includes a hollow elongate member (10) having at least one ink supply channel **(20*a*) formed therein, the, or each ink supply channel (20*a*) being in fluid communication with an elongate slot (21) in and extending at least partly along the elongate member (10). A plurality of printhead segment carriers (8) is received and secured in neighbouring arrangement within the slot (21), and at least one printhead segment (4) is mounted to each printhead segment carrier (8). Each printhead segment carrier (8) includes at least one ink gallery (92) arranged so as to connect the or a associated one of said ink supply channels (20*a*) with an ink inlet (41) of the at least one printhead segment (4) mounted to that printhead segment carrier (8). The inkjet printhead segments (4) are both conveniently supported in the elongate member (10)** and supplied with ink, and their printing ranges may overlap longitudinally.

51 Claims, 20 Drawing Sheets

PRINTHEAD SUPPORT STRUCTURE AND ASSEMBLY

FIELD OF THE INVENTION

This invention relates to the field of ink jet printing systems, and more specifically to a support structure and ink supply arrangement for a printhead assembly and such printhead assemblies for ink jet printing systems.

DESCRIPTION OF THE PRIOR ART

Micro-electromechanical systems ("MEMS"), fabricated using standard VLSI semi-conductor chip fabrication techniques, are becoming increasingly popular as new applications are developed. Such devices are becoming widely used for sensing (for example accelerometers for automotive airbags), inkjet printing, micro-fluidics, and other applications. The use of semi-conductor fabrication techniques allows MEMS to be interfaced very readily with microelectronics. A broad survey of the field and of prior art in relation thereto is provided in an article entitled "The Broad Sweep of Integrated Micro-Systems", by S. Tom Picraux and Paul McWhorter, in IEEE Spectrum, December 1998, pp24–33.

In PCT Application No. PCT/AU98/00550, the entire contents of which is incorporated herein by reference, an inkjet printing device has been described which utilizes MEMS processing techniques in the construction of a thermal-bend-actuator-type device for the ejection of a fluid, such as an ink, from a nozzle chamber. Such ink ejector devices will be referred to hereinafter as MEMJETs. The technology there described is intended as an alternative to existing technologies for inkjet printing, such as Thermal Ink Jet (TIJ) or "Bubble Jet" technology developed mainly by the manufacturers Canon and Hewlett Packard, and Piezoelectric Ink Jet (PIJ) devices, as used for example by the manufacturers Epson and Tektronix.

While TIJ and PIJ technologies have been developed to very high levels of performance since their introduction, MEMJET technology is able to offer significant advantages over these technologies. Potential advantages include higher speeds of operation and the ability to provide higher resolution than obtainable with other technologies. Similarly, MEMJET Technology provides the ability to manufacture monolithic printhead devices incorporating a large number of nozzles and of such size as to span all or a large part of a page (or other print surface), so that pagewidth printing can be achieved without any need to mechanically traverse a small printhead across the width of a page, as in typical existing inkjet printers.

It has been found difficult to manufacture a long TIJ printhead for full-pagewidth printing. This is mainly because of the high power consumption of TIJ devices and the problem associated therewith of providing an adequate power supply for the printhead. Similarly, waste heat removal from the printhead to prevent boiling of the ink provides a challenge to the layout of such printhead. Also, differential thermal expansion over the length of a long TIJ-printhead my lead to severe nozzle alignment difficulties.

Different problems have been found to attend the manufacture of long PIJ printheads for large or full-page-width printing. These include acoustic crosstalk between nozzles due to similar time scales of drop ejection and reflection of acoustic pulses within the printhead. Further, silicon is not a piezoelectric material, and is very difficult to integrate with CMOS chips, so that separate external connections are required for every nozzle.

Accordingly, manufacturing costs are very high compared to technologies such as MEMJET in which a monolithic device may be fabricated using established techniques, yet incorporate very large numbers of individual nozzles. Reference should be made to the aforementioned PCT application for detailed information on the manufacture of MEMJET inkjet printhead chips; individual MEMJET printhead chips will here be referred to simply as printhead segments. A printhead assembly will usually incorporate a number of such printhead segments.

While MEMJET technology has the advantage of allowing the cost effective manufacture of long monolithic printheads, it has nevertheless been found desirable to use a number of individual printhead segments (CMOS chips) placed substantially end-to-end where large widths of printing are to be provided. This is because chip production yields decrease substantially as chip lengths increase, so that costs increase. Of course, some printing applications, such as plan printing and other commercial printing, require printing widths which are beyond the maximum length that is practical for successful printhead chip manufacture.

SUMMARY OF THE INVENTION

The present invention is broadly directed to the provision of a suitable printhead segment support structure and ink supply arrangement for an inkjet printhead assembly capable of single-pass, full-pagewidth printing as well as to such printhead assemblies. While the invention was conceived in the context of MEMJET printhead segments (chips), and thus the following summary and description of the invention is provided with particular reference to printhead assemblies incorporating MEMJET printhead segments, it is believed that the invention also has the potential to be employed with other ink jet printhead technologies.

Accordingly, it is one object of the present invention to provide a printhead segment support structure that is capable of accommodating a series of printhead segments as described in PCT/AU98/00560 in an array that permits single-pass pagewidth printing across the width of a surface passing under the printhead assembly.

The term "single-pass pagewidth printing" should here be understood as referring to a printing operation during which the printhead assembly is moved in only one direction along or across the entire width or length of any print surface, as compared to a superimposed, generally orthogonal printhead carriage movement as employed in conventional ink jet printers. (Of course, printhead assembly movement may be relative, with the surface moving past a stationary printhead assembly.) It will be also understood that there are many possible page widths and the inkjet printhead segment support structure of the invention would be suitable for adaptation to a range of widths. A printhead assembly in accordance with the invention should in particular be useful where a plurality of generally elongate, but relatively small printhead segments are to be used to print across substantially the entire width of a sizable surface without the need for mechanically moving the printhead assembly or any printhead segment across as well as along the print surface.

The invention has also been conceived in light of potential problems related to the relatively small size of individual printhead segments, their fragility and the required highly accurate alignment or registration of individual printhead segments with each other on the support structure and with external components in order to provide a printhead assembly capable of single-pass, full pagewidth printing. Multiple ink supply channels are required to supply ink in reliable manner to all printhead segments. Because of the small size of the segments, this in general would require high quality micro-machined parts. An ink supply conduit, on the other hand, is most economically made if it can be formed at a much coarser scale.

Accordingly, another object of the invention is to provide a printhead segment support structure with a print fluid supply arrangement that ensures adequate print fluid (eg ink) supply to individual printhead segments mounted to the support structure, at an affordable manufacturing cost.

Typical MEMJET printhead segments have a dimension of 2 cm length by 0.5 mm width, and will include (in a layout for 4-color printing) four lengthwise-oriented rows of ink ejection nozzles, the segment being of monolithic fabrication. Longer segments could be made and used, but the size mentioned gives very satisfactory fabrication yields. Each printhead segment has ink inlet holes arrayed on one surface and corresponding nozzle outlets arrayed on an opposite surface. Each of the four rows will then require connection to an appropriate ink supply, such that an inkjet printhead assembly can be provided for operation with (for example) cyan, magenta, yellow and black inks for color printing.

Accordingly, a yet further object is to provide an ink supply arrangement thereby to enable supply of a number of differently colored inks (or other printing fluids) to selected ink inlets of individual printhead segments carried on a support structure for full pagewidth color printing.

Another herewith related object of the invention is to provide a print fluid supply arrangement that is simple in layout and thus easy to incorporate in a printhead support structure. It should ensure even and reliable distribution of print fluids in a pagewidth inkjet printhead assembly.

In a first aspect, the invention provides a support for a plurality of inkjet printhead segments, said support including:

a hollow elongate member having at least one ink supply channel formed therein, the or each ink supply channel being in fluid communication with an elongate slot in and extending at least partly along the elongate member; and a plurality of printhead segment carriers received and secured in neighbouring arrangement within the slot, each printhead segment carrier being adapted for mounting thereto of at least one printhead segment, wherein each printhead segment carrier includes at least one ink gallery arranged so as to connect the or an associated one of said ink supply channels with an ink inlet of said at least one printhead segment when mounted to that printhead segment carrier.

In a second aspect, the invention provides an inkjet printhead assembly including:

a hollow elongate member having at least one ink supply channel formed therein, the or each ink supply channel being in fluid communication with an elongate slot in and extending at least partly along the elongate member; and a plurality of printhead segment carriers received and secured in neighbouring arrangement within the slot; and at least one printhead segment mounted to each printhead segment carrier, wherein each printhead segment carrier includes at least one ink gallery arranged so as to connect the or an associated one of said ink supply channels with an ink inlet of the at least one printhead segment mounted to that printhead segment carrier.

It is preferred that the at least one printhead segment on each printhead segment carrier has a defined printing range in a direction lengthwise along the elongate member, and that the printing ranges of the printhead segments mounted to a plurality of adjoining printhead segment carriers overlap, so that the printhead segments mounted to said plurality of adjoining printhead segment carriers have a combined printing range of greater lengthwise extent than any of the printing ranges comprised therein. This is a suitable way in which printing may be accomplished on a surface without the presence of gaps corresponding to lengthwise gaps between individual printhead segments.

In a further aspect, the invention provides a method for assembling the inkjet printhead assembly wherein the step of mounting to each printhead segment carrier its respective at least one printhead segment precedes the step of securing that printhead segment carrier within the slot. It is then preferred that the printhead segment carriers are secured within the slot sequentially, and that the at least one printhead segment in each printhead segment carrier installed after the first is positioned longitudinally relative to the at least one printhead segment in the printhead segment carrier last installed before being finally secured and immobilized within the slot. Thus, accurate relative positioning of successive printhead segments lengthwise along the elongate member can be achieved.

Other aspects, objects and advantages of the invention, in its different embodiments, will also become apparent from the description given below of preferred embodiments and from the appended claims.

DESCRIPTION OF THE PREFERRED EMBODIMENT

Figure 1:
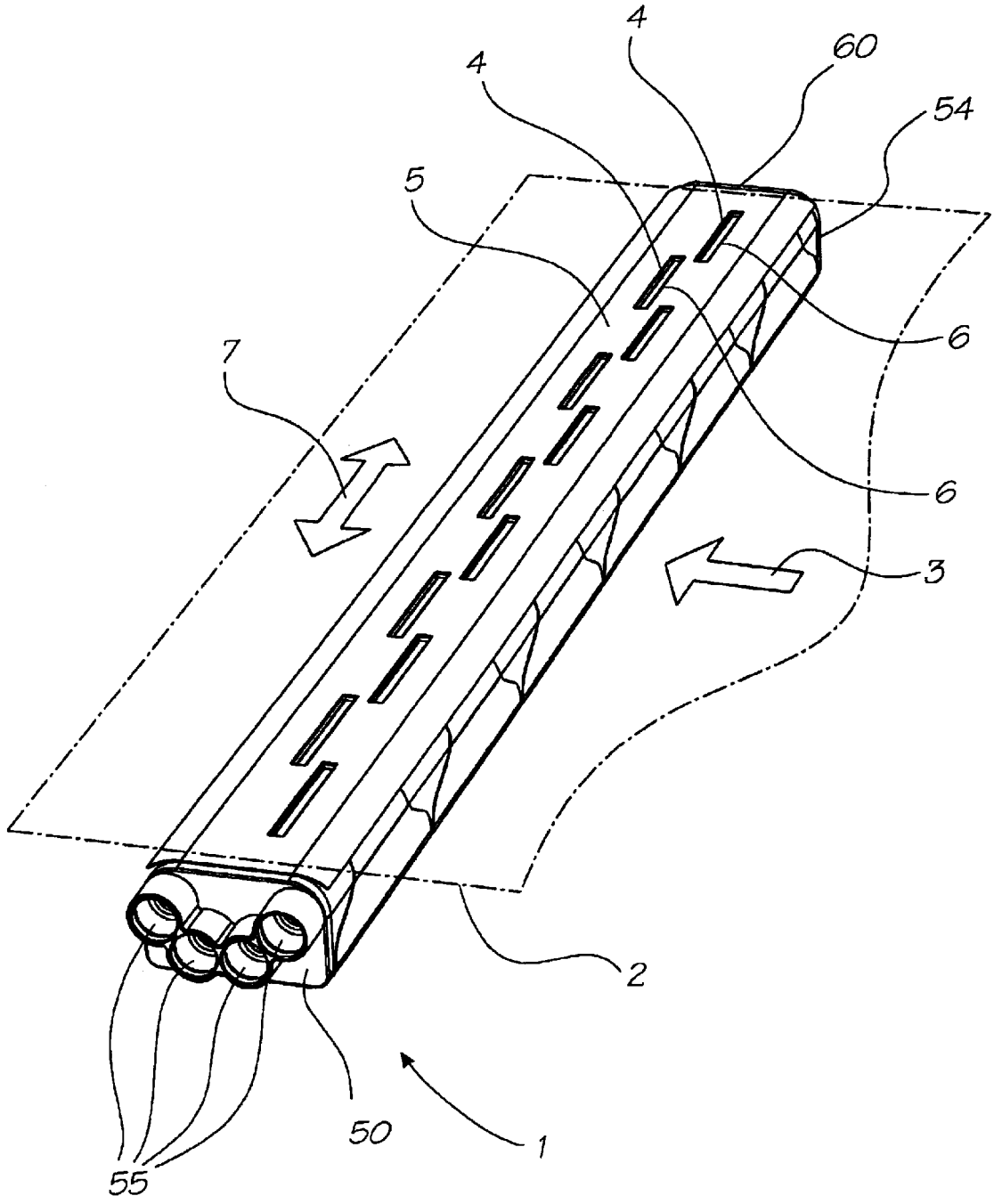
FIG. 1 is a perspective view of one embodiment of an inkjet printhead assembly according to the invention.

FIG. 1 shows in perspective view an inkjet printhead assembly 1 according to one aspect of the invention and, in phantom outline, a surface 2 on which printing is to be effected. In use, the surface 2 moves relative to the assembly 1 in a direction indicated by arrow 3 and transverse to the main extension of assembly 1 (this direction is hereinafter also referred to as the transverse direction of the assembly 1), so that elongate printhead segments 4, in particular MEMJET printhead segments such as described in the above-mentioned PCT/AU98/00550, placed in stepped overlapping sequence along the lengthwise extension of assembly 1 can print simultaneously across substantially the entire width of the surface. The assembly 1 includes a shield plate 5 with which the surface 2 may come into sliding contact during such printing. Shield plate 5 has slots 6, each corresponding to one of the printhead segments 4, and through which ink ejected by that printhead segment 4 can reach surface 2.

The particular assembly 1 shown in FIG. 1 has eleven printhead segments 4, each capable of printing along a 2 cm printing length (or, in other words, within a printing range extending 2 cm) in a direction parallel to arrow 7 (hereinafter also called the lengthwise direction of the assembly 1) and is suitable for single-pass printing of a portrait A4-letter size page. However, this number of printhead segments 4 and their length are in no way limiting, the invention being applicable to printhead assemblies of varying lengths and incorporating other required numbers of printhead segments 4.

The slots 6 and the printhead segments 4 are arranged along two parallel lines in the lengthwise direction, with the printing length of each segment 4 (other than the endmost segments 4) slightly overlapping that of its two neighboring segments 4 in the other line. The printing length of each of the two endmost segments 4 overlaps the printing length of its nearest neighbour in the other row at one end only. Thus printing across the surface 2 is possible without gaps in the lengthwise direction of the assembly. In the particular assembly shown, the overlap is approximately 1 mm at each end of the 2 cm printing length, but this figure is by no means limiting.

Figure 2:
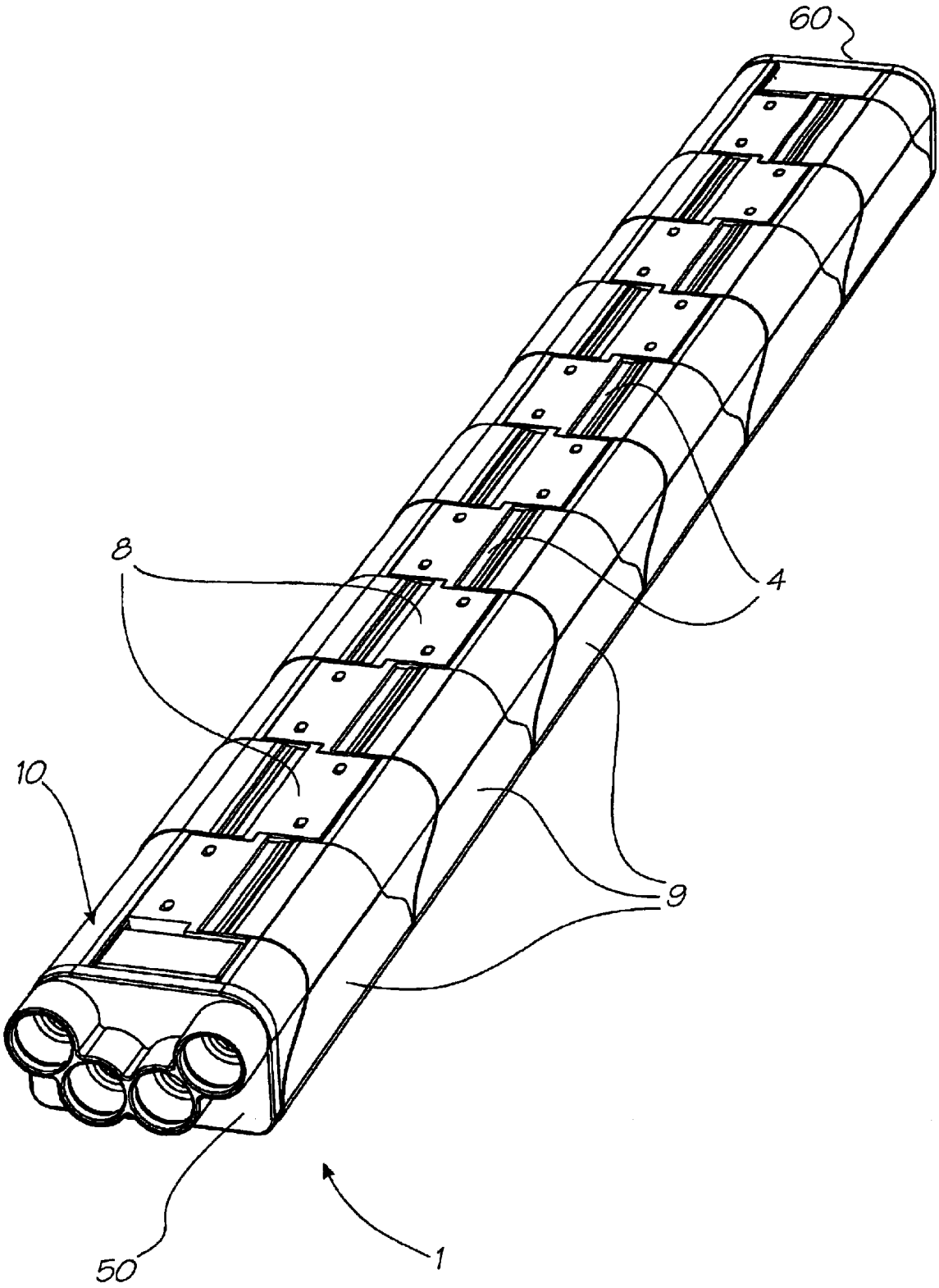
FIG. 2 is a perspective view of the inkjet printhead assembly shown in FIG. 1, with a cover component (shield plate) removed.

FIG. 2 shows assembly 1 with the shield plate 5 removed. Each printhead segment 4 is secured to an associated one printhead segment carrier 8 that will be described below in more detail. Also secured to each printhead segment 4 is a tape automated bonded (TAB) film 9 which carries signal and power connections (not individually shown) to the associated printhead segment 4. Each TAB film 9 is closely wrapped around an extruded support profile 10 (whose function will be explained below) that houses and supports carriers 8, and they each terminate onto a printed circuit board (PCB) 11 secured to the profile 10 on a side thereof opposite to that where the printhead segments 4 are mounted, see also FIG. 3.

Figure 3:
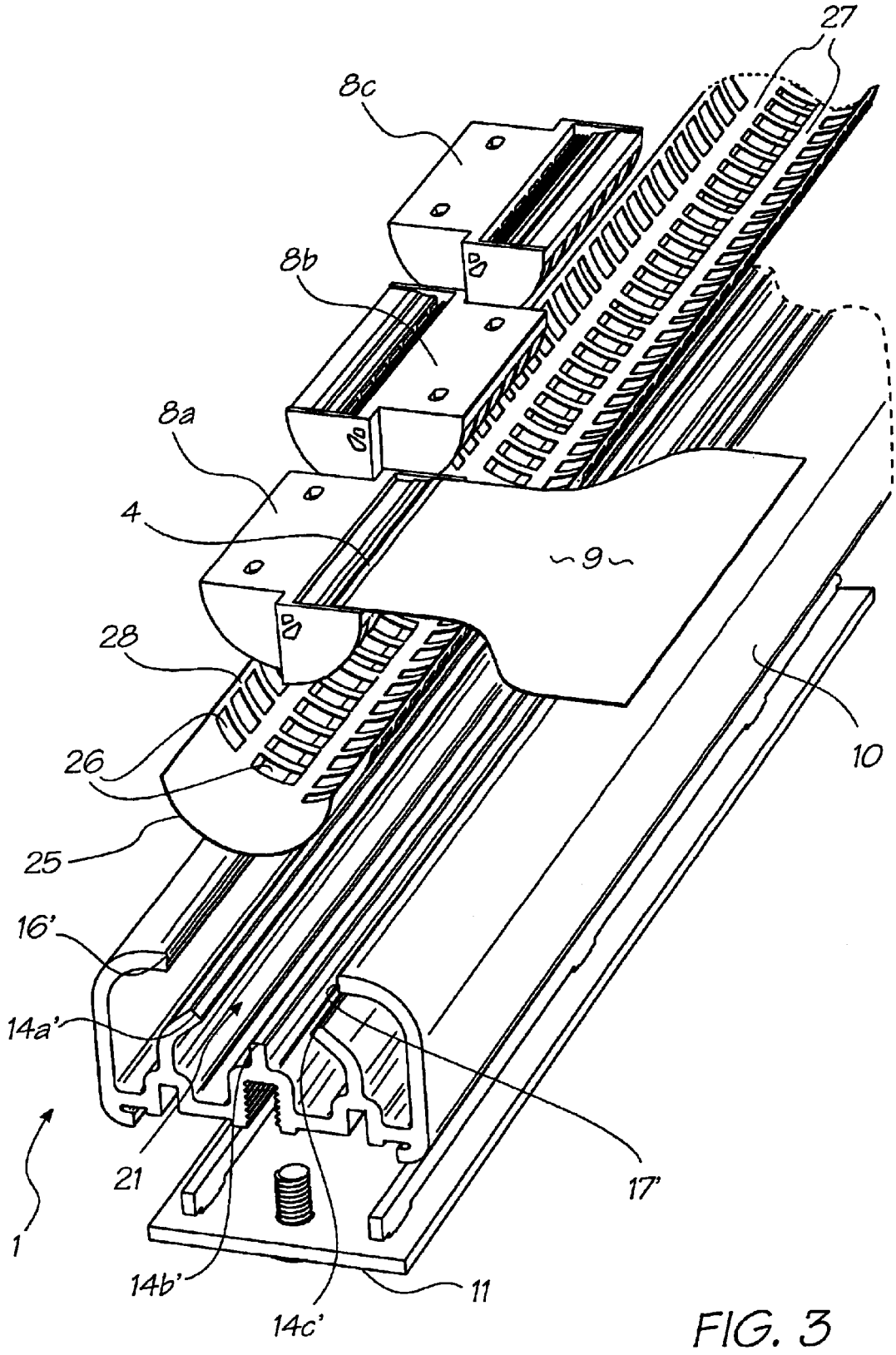
FIG. 3 is an exploded perspective view of a part only of the inkjet printhead assembly shown in FIG. 1.

FIG. 3 shows an exploded perspective view of a part only of assembly 1. In this view, three only of the printhead segment carriers 8 are shown numbered 8*a*, 8*b* and 8*c*, and only the printhead segment 4 associated with printhead segment carrier 8*a* is shown and numbered 4*a*. The TAB film 9 associated therewith is terminated at one end on an outer face of the printhead segment 4 and is otherwise shown (for clarity purposes) in the unwound, flat state it has before being wound around profile 10 and connected to PCB 11. As can be seen in FIG. 3, printhead segment carriers 8 are received (and secured), together with an interposed sealing shim 25, in a slot 21 of half-circular cross-sectional shape in profile member 10 as will be explained in more detail below.

Figure 4:
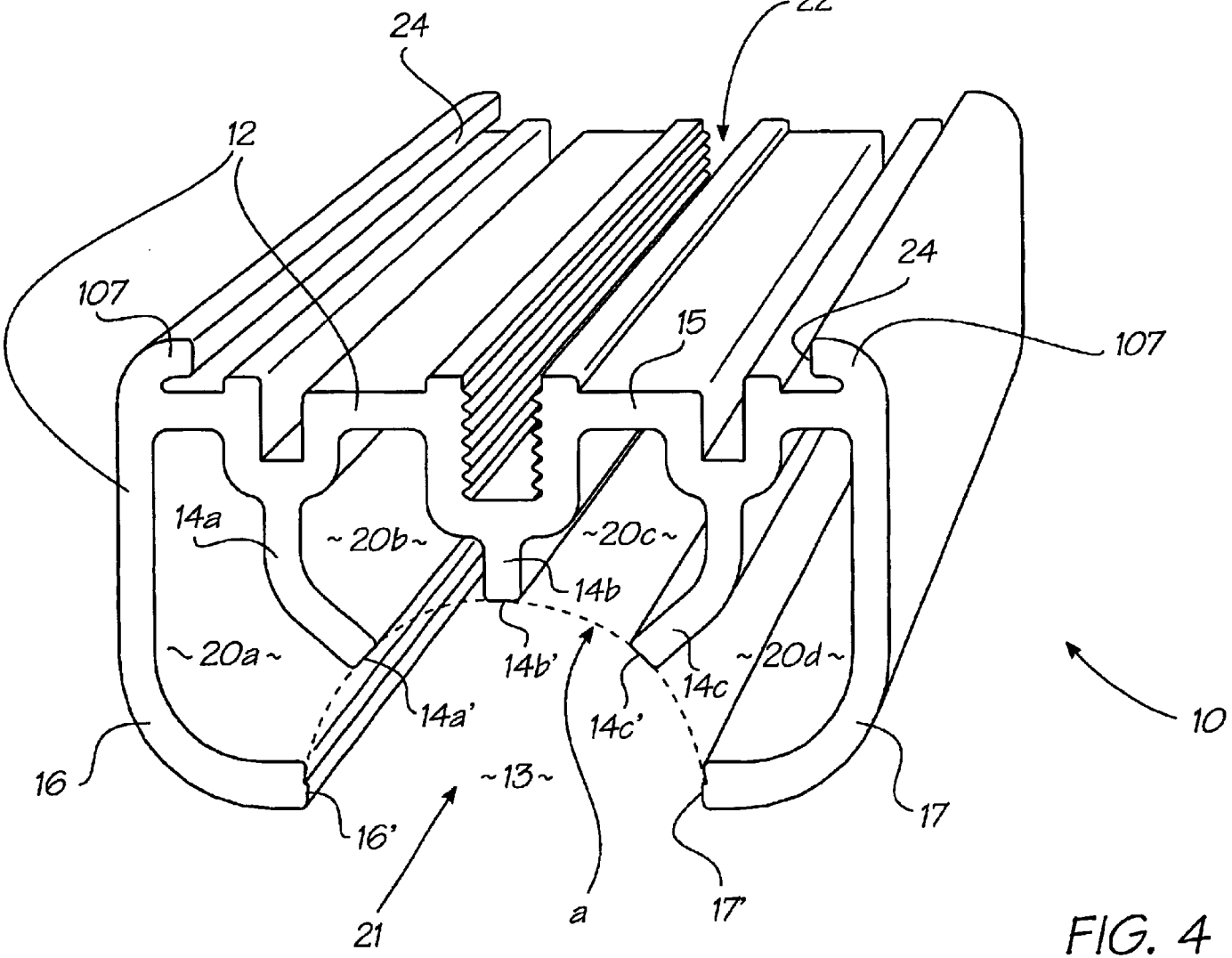
FIG. 4 is a perspective partial view of a support extrusion forming part of the inkjet printhead assembly shown in FIG. 3.

FIG. 4 illustrates a cross-section of the profile member 10 (which is preferably an aluminium alloy extrusion). This component serves as a frame and/or support structure for the printhead segment carriers 8 (with their associated printhead segments 4 and TAB films 9), the PCB 11 and shield plate 5. It also serves as an integral ink supply arrangement for the printhead segments 4, as will become clearer later.

Profile member 10 is of semi-open cross-section, with a peripheral, structured wall 12 of uniform thickness. Free, opposing, lengthwise running edges 16', 17' of side wall sections 16 and 17 respectively of wall 12 border or delineate a gap 13 in wall 12 extending along the entire length of profile member 10. Profile member 10 has three internal webs 14*a*, 14*b*, 14*c* that stand out from a base wall section 15 of peripheral wall 12 into the interior of member 10, so as to define together with side wall sections 16 and 17 a total of four (4) ink supply channels 20*a*, 20*b*, 20*c* and 20*d* which are open towards the gap 13. The, shapes, proportions and relative arrangement of the webs and wall sections 14*a–c*, 16, 17 are such that their respective free edges 14*a'*, 14*b'*, 14*c'* and 16', 17', as viewed in the lengthwise direction and cross-section of profile member 10, define points on a semi-circle (indicated by a dotted line at "a" in FIG. 4). In other words, an open slot 21 of semicircular cross-sectional shape is defined along one side of profile member 10 that runs along its extension, with each of the ink supply channels 20*a–d* opening into common slot 21.

Base wall section 15 of profile member 10 also includes a serrated channel 22 opening towards the exterior of member 10, which, as best seen in FIG. 3, serves to receive fastening screws 23 to fixedly secure PCB 11 onto profile member 10 in a form-fitting manner between free edges 24 (see FIG. 4) of longitudinally extending curved webs 107 extending from the base wall section 15 of profile member 10.

Figure 5:
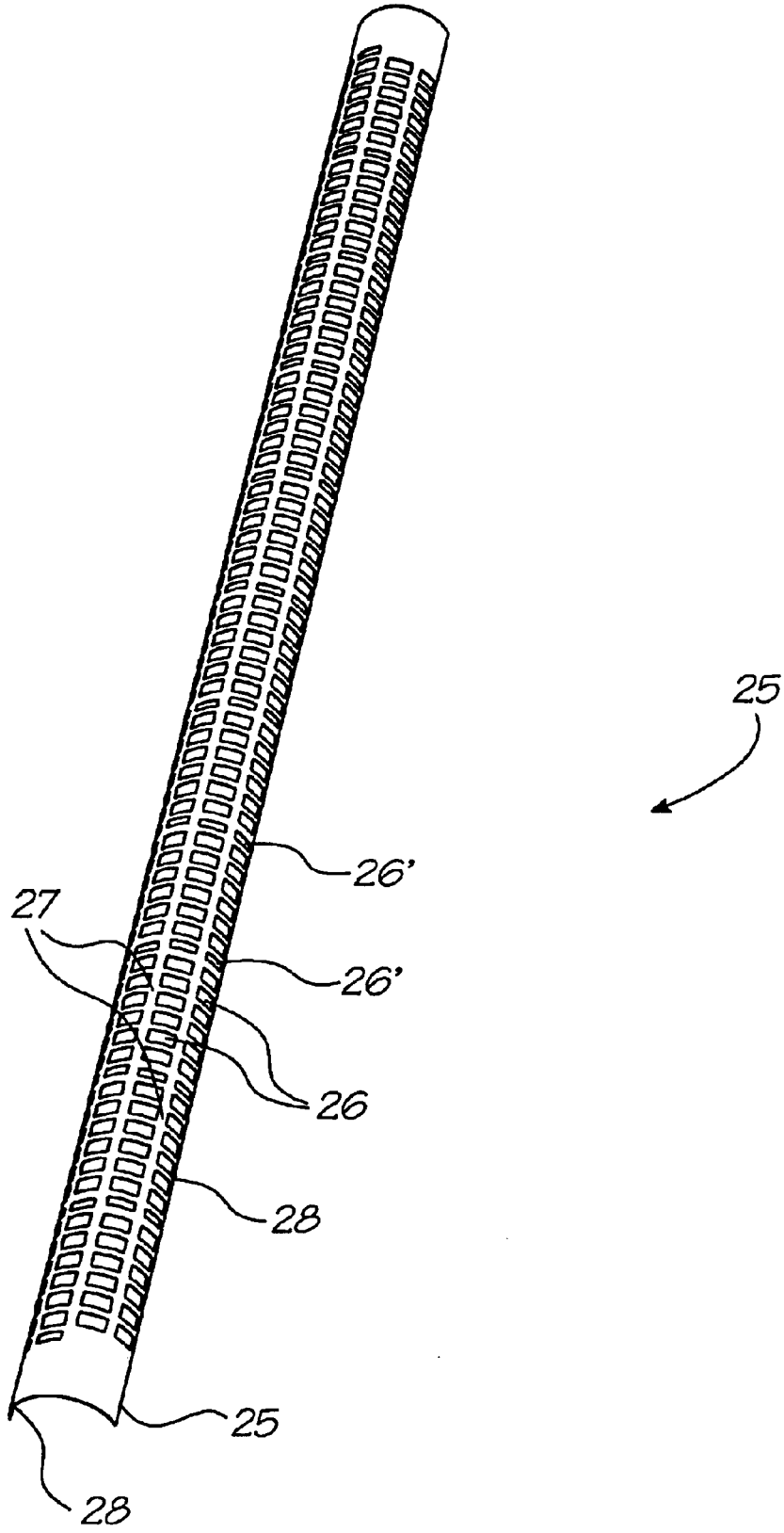
FIG. 5 is a perspective view of a sealing shim forming part of the inkjet printhead assembly shown in FIG. 3.

Referring again to FIG. 3, sealing shim 25 is received (and secured) within the half-circular open slot 21. As best seen in FIGS. 3 and 5, shim 25 includes four lengthwise extending rows of rectangular openings 26 that are equidistantly spaced in peripheral (widthwise) direction of shim 25, so that three lengthwise-extending web sections 27 between the aperture rows (of which two are visible in FIG. 5) are located so as to be brought into abutting engagement against the free edges 14*a*', 14*b*' and 14*c*' of webs 14*a*, 14*b*, 14*c* of profile member 10 when shim 25 is received in slot 21. As can be gleaned from FIG. 4, the free edges 16' and 17' of side wall sections 16, 17 of profile member 10 are shaped such as to provide a form-lock for retaining the lengthwise extending edges 28 of shim member 25 as a snap fit. In other words, once shim 25 is mounted in profile member 10, it provides a perforated bottom for slot 21, which allows passage of inks from the ink supply channels 20*a–d* through apertures 26 in shim 25 into slot 21. A glue or sealant is provided where shim webs 27 and edges 28 mate with the free edges 14*a*', 14*b*', 14*c*', 16' and 17' of profile member 10, thereby preventing cross-leakage between ink supply channels 20*a–d* along the abutting interfaces between shim 25 and profile member 10. It will be noted from FIG. 5 that not all apertures 26 have the same opening size. Reference numerals 26' indicate two such smaller apertures, the significance of which is described below, which are present in each aperture row at predetermined aperture intervals. A typical size for the full-sized apertures 26 is 2 mm×2 mm. The shim is preferably of stainless steel, but a plastics sheet material may also be used.

Figure 6:
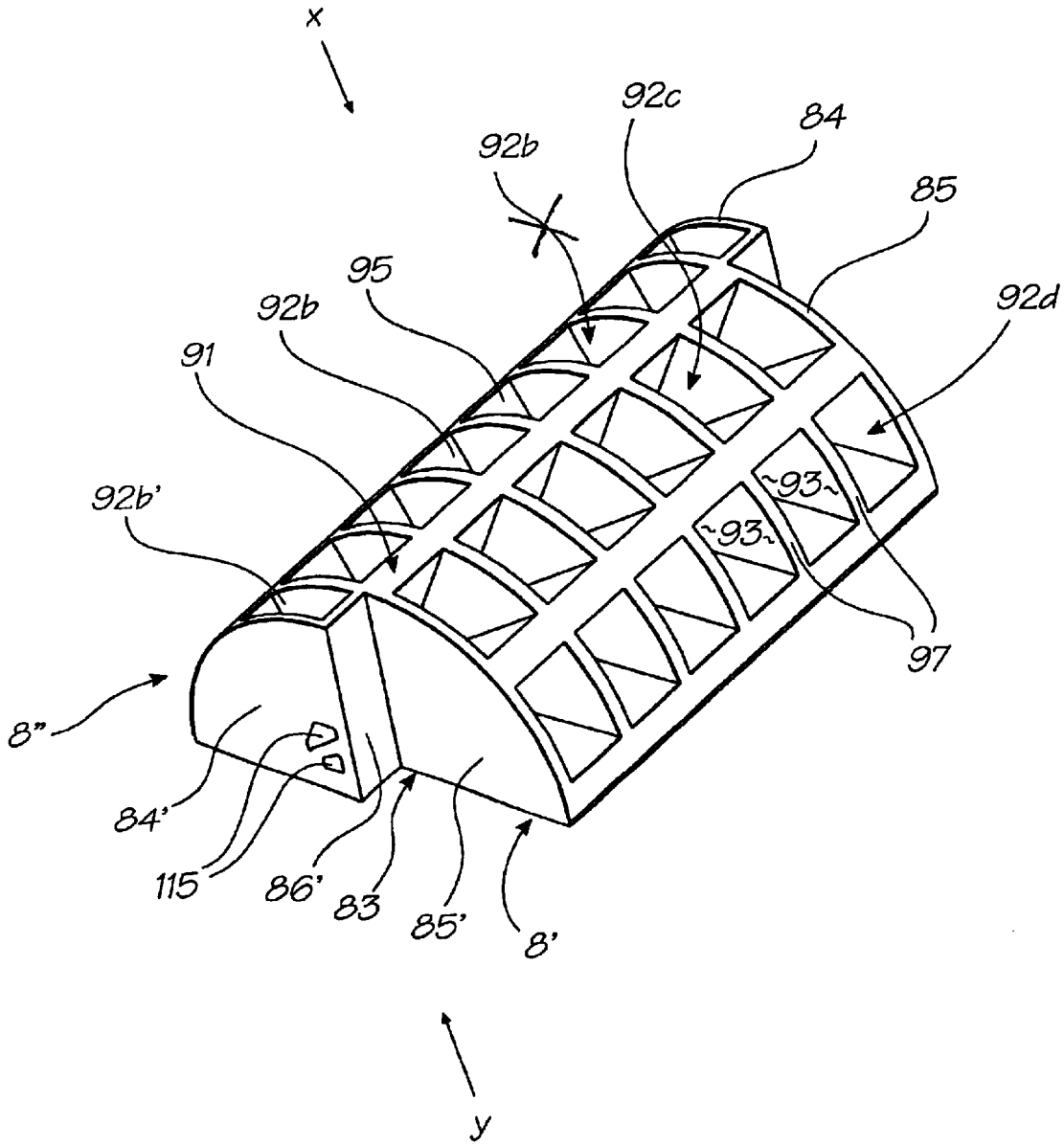
FIG. 6 is a perspective view of a printhead segment carder shown in FIG. 3.
Figure 7:
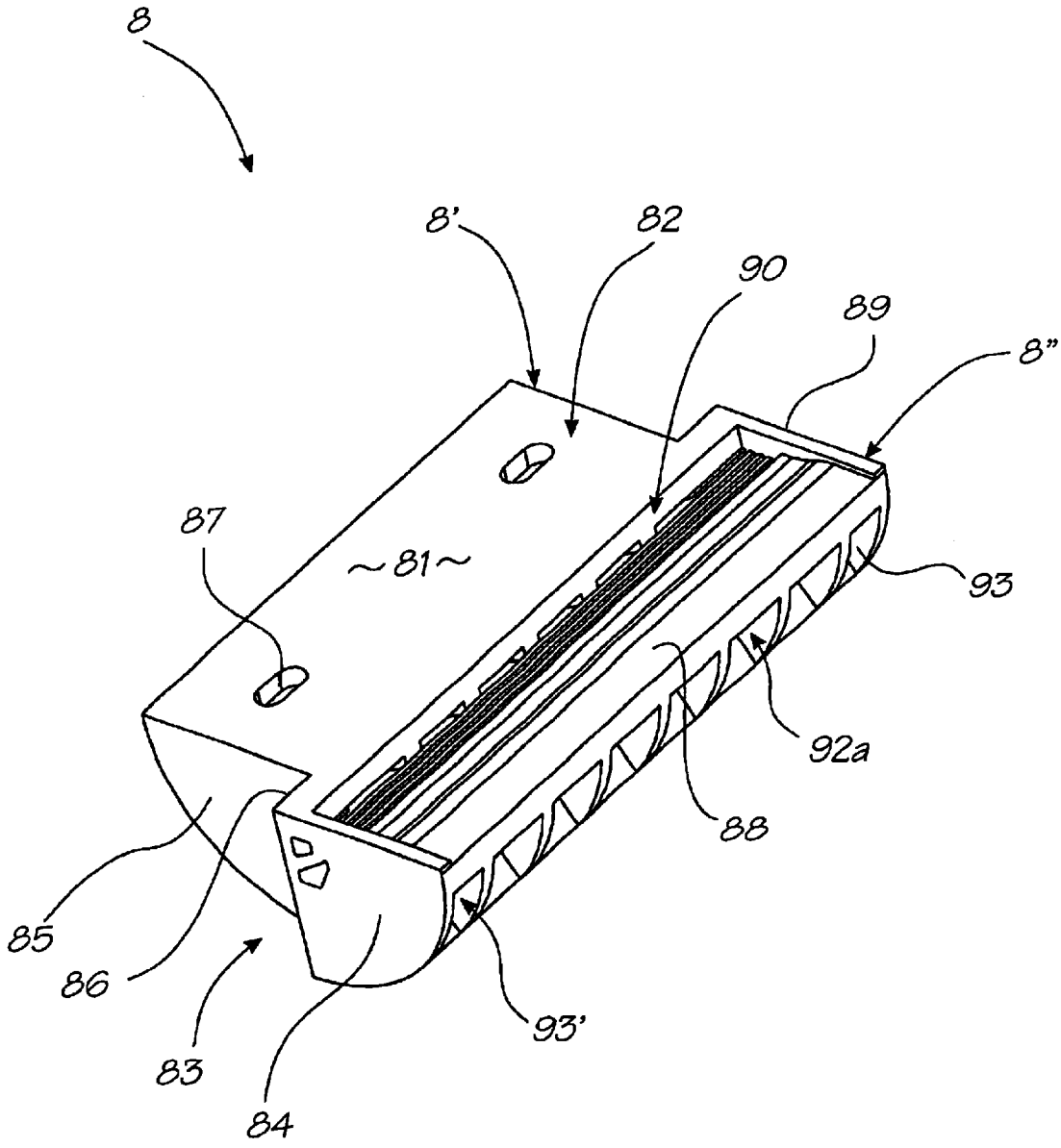
FIG. 7 is a further perspective view of the printhead segment carrier shown in FIG. 6.
Figure 8:
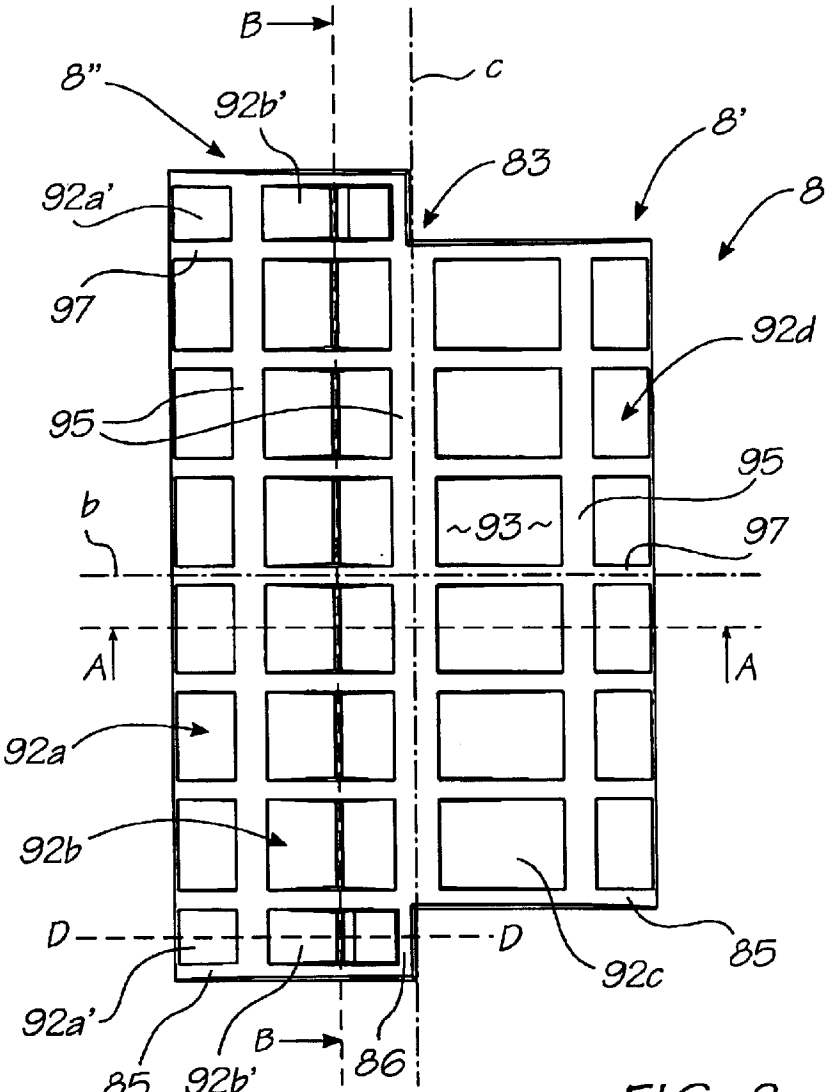
FIG. 8 is a bottom elevation of the printhead carrier shown in FIGS. 6 and 7 (as viewed in the direction of arrow "X" in FIG. 6)
Figure 9:
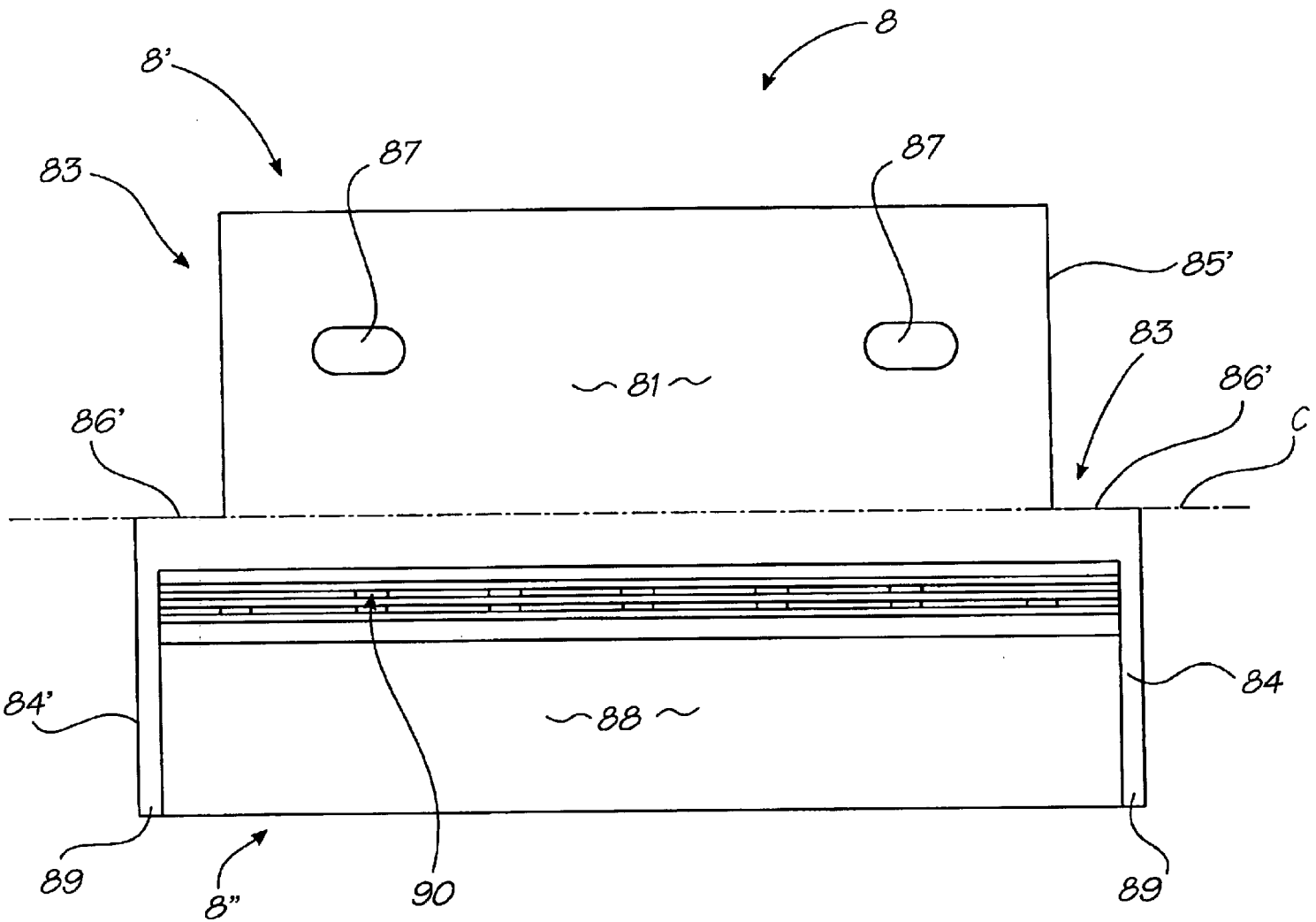
FIG. 9 is a top elevation of the printhead carrier shown in FIGS. 6 and 7 (as viewed in the direction of arrow "Y" in FIG. 6)

Turning next to FIGS. 6–12, these illustrate in different views and sections a typical printhead segment carrier 8. Carrier 8 is preferably a single micro-injection molded part made of a suitable temperature and abrasion resistant and form-holding plastics material. (A further manufacturing operation is carried out subsequent to molding, as described below.) As best seen in FIGS. 6 and 7, the overall external shape of carrier 8 can be described illustratively as a diametrically slit half cylinder, with a half-circular back face 91, a partly planar front face 82 and stepped end faces 83. FIG. 8 shows a plan view of back face 91 and FIG. 9 shows a plan view of front face 82.

Figure 10:
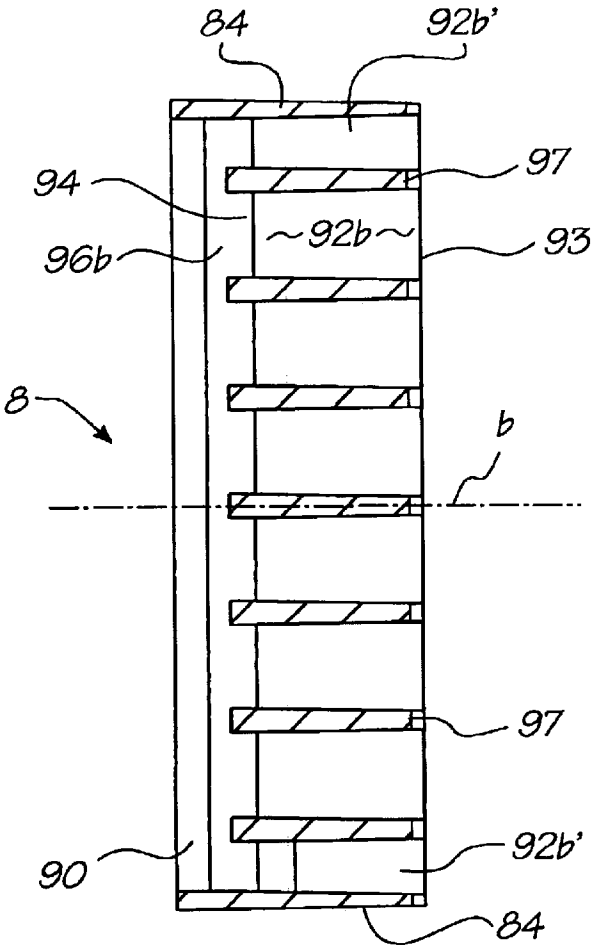
FIG. 10 is a cross-sectional view of the printhead carrier of FIGS. 6 and 7 taken at station "B—B" in FIG. 8.

Carrier 8 has a plane of symmetry halfway along, and perpendicular to, its length, that is, as indicated by lines marked "b" in FIGS. 8 and 10 which lie in the plane. Line "b" as shown in FIG. 8 extends in a direction that will hereinafter be described as transverse to the carrier 8. (When the carrier 8 is installed in the assembly 1, this direction is the same as the transverse direction of the assembly 1.) Lines marked "c" in FIGS. 8, 9, 11 and 12 together similarly indicate the position of an imaginary plane which lies between two sections of the carrier 8 of different length and whose overall cross-sectional shapes are quarter circles. Line "c" as shown in FIG. 9 extends in a direction that will hereinafter be described as lengthwise in the carrier 8. (When the carrier 8 is installed in the assembly 1 this direction is the same as the lengthwise direction of the assembly 1.) These sections will hereinafter be referred to as the shorter and longer "quarter cylinder" sections 8' and 8", respectively, to allow referenced description of features of the carrier 8.

Each stepped end face 83 includes respective outer faces 84' and 85' of quarter-circular-sector shaped end walls 84 and 85 and an outer face 86' of an intermediate step wall 86 between and perpendicular to end walls 84, 85. This configuration enables carriers 8 to be placed in the slot 21 of profile 10 in such a way that adjoining carriers 8 overlap in the lengthwise direction with the step walls 86 of pairs of neighbouring carriers 8 facing each and overlapping. Such an "interlocking" arrangement is shown in FIG. 2, wherein it is apparent that every one of the eleven (11) carriers 8 has an orientation, relative to its neighbouring carrier or carriers 8, such that faces 84' and 85' of each carrier lie adjacent to faces 85' and 84', respectively, of its neighbouring carrier(s) 8. In other words, each carrier 8 is so oriented in relation to its neighbouring carrier(s) as to be rotated relatively by 180° about an axis perpendicular to the face 82. In essence, neighbouring carriers 8 will align along a common lengthwise-oriented plane defined between the step walls 86 of adjoining carriers 8, shorter and longer quarter cylinder sections 8' and 8" of adjoining carriers 8 alternating with one another along the extension of slot 21.

Figure 11:
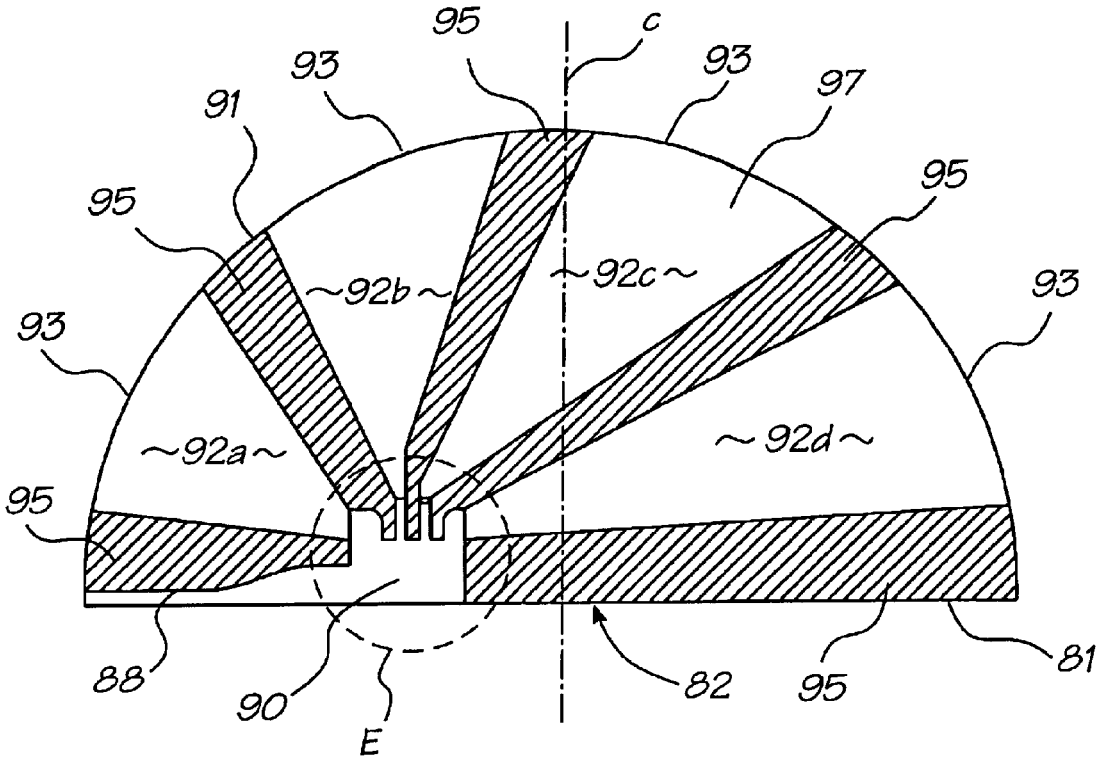
FIG. 11 is a cross-sectional view of the printhead carrier of FIGS. 6 and) and 7 taken at station "A—A" in FIG. 8.
Figure 11A:
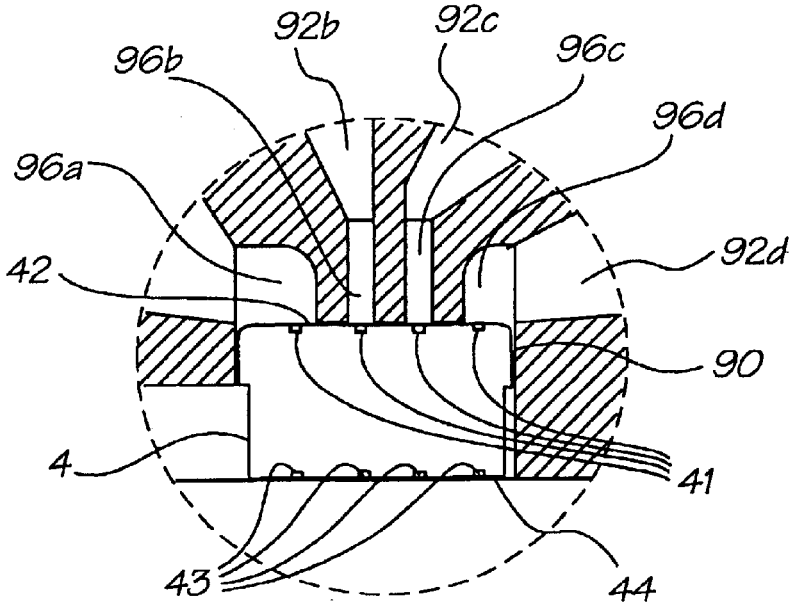
FIG. 11*a* is an enlarged cross-sectional view of the seating arrangement of a printhead segment at the print carrier as per detail "E" in FIG. 11.

Turning now in particular to FIGS. 7, 9, 11 and 11*a*, front face 82 of carrier 8 includes on the shorter quarter cylinder section 8' a planar surface 81. Formed in surface 81 are two handling (i.e. pick-up) slots 87 whose purpose is described below. On the longer quarter cylinder section 8", front face 82 incorporates a mounting, or support surface 88 recessed with respect to edges 89 of sector-shaped end walls 84 that are co-planar with the surface 81. As best seen in FIG. 11, mounting surface 88 recedes in slanting fashion from a point on the back face 91 of the longer quarter cylinder section 8" towards an elongate recess 90 extending lengthwise between walls 84. Recess 90 is of constant transverse cross-section along its length and is shaped to receive in form-fitting manner one printhead segment 4. FIG. 11*a* shows, schematically only, printhead segment 4 in position in recess 90. Mounting surface 88 is provided to accommodate in flush manner with respect to the surface 81 the terminal end of TAB film 9 connected to printhead segment 4, as is best seen in FIG. 3. Due to the opposing orientations of neighbouring carriers 8 along the extension of assembly 1, the TAB films 9 associated with any two neighbouring carriers 8 lead away from their respective segments 4 in opposite transverse directions, as can be seen in FIG. 2.

Referring now to FIGS. 6, 7, 8, 10 and 11 in particular, four rows of ink galleries or ink supply passages 92*a* to 92*d* of generally quadrilateral cross-section are formed within the printhead segment carrier 8. The ink galleries 92*a* to 92*d* act as conduits for ink to pass from the ink supply passages 20*a* to 20*d*, respectively, via openings 26 in the shim 25, to the printhead segment 4 mounted in recess 90 of the printhead segment carrier 8. Galleries 92*a–*92*d* extend in quasi-radial arrangement between the half-cylindrical back face 91 of carrier 8 and recess 90 located in the longer quarter cylinder section 8" at front face 82. The expression "quasi-radial" is used here because recess 90 is not located at a transversely central position across carrier 8, but is offset into the longer quarter cylinder section 8", so that the inner ends of galleries 92*a–*92*d* are similarly off-set, as further described below. Each gallery 92 has a rectangular opening 93 at back face 91. All rectangular openings 93 have the same dimension in a peripheral direction of face 91 and are equidistantly spaced around the periphery of back face 91. Moreover, the openings 93 are symmetrically located on opposing sides of the boundary between shorter quarter cylinder section 8' and longer quarter cylinder section 8", as represented in FIG. 11 by the line marked "c". All openings 93 in the shorter quarter cylinder section 8' are of the same dimension, and equispaced, in the lengthwise direction. This also applies to the openings 93 in the longer quarter cylinder section 8", except that openings 93' in the longer quarter cylinder section 8" which correspond to endmost galleries 92*a*' and 92*b*' are of smaller dimension in the lengthwise direction than the other galleries 92*a* and 92*b*, respectively.

By way of further description of how the galleries 92*a* to 92*d* are formed, printhead segment carrier 8 includes a set of five (5) quasi-radially converging walls 95 which converge from back face 91 towards recess 90 at front face 82 and two of which define the faces 81 and 88. The walls 95 perpendicularly intersect seven (7) generally semi-circular and mutually parallel walls 97 that are equidistantly spaced apart in lengthwise extension of carrier 8. Of walls 97, the two endmost ones extending into the shorter quarter cylinder section 8' provide the endwalls 85 of stepped end faces 83, thereby defining twenty-four (24) quasi-radially extending ink galleries 92*a* to 92*d*, of quadrilateral cross-section, in four lengthwise-extending rows each of six galleries. The walls 97 are parallel to and lie between endwalls 84.

Figure 12:
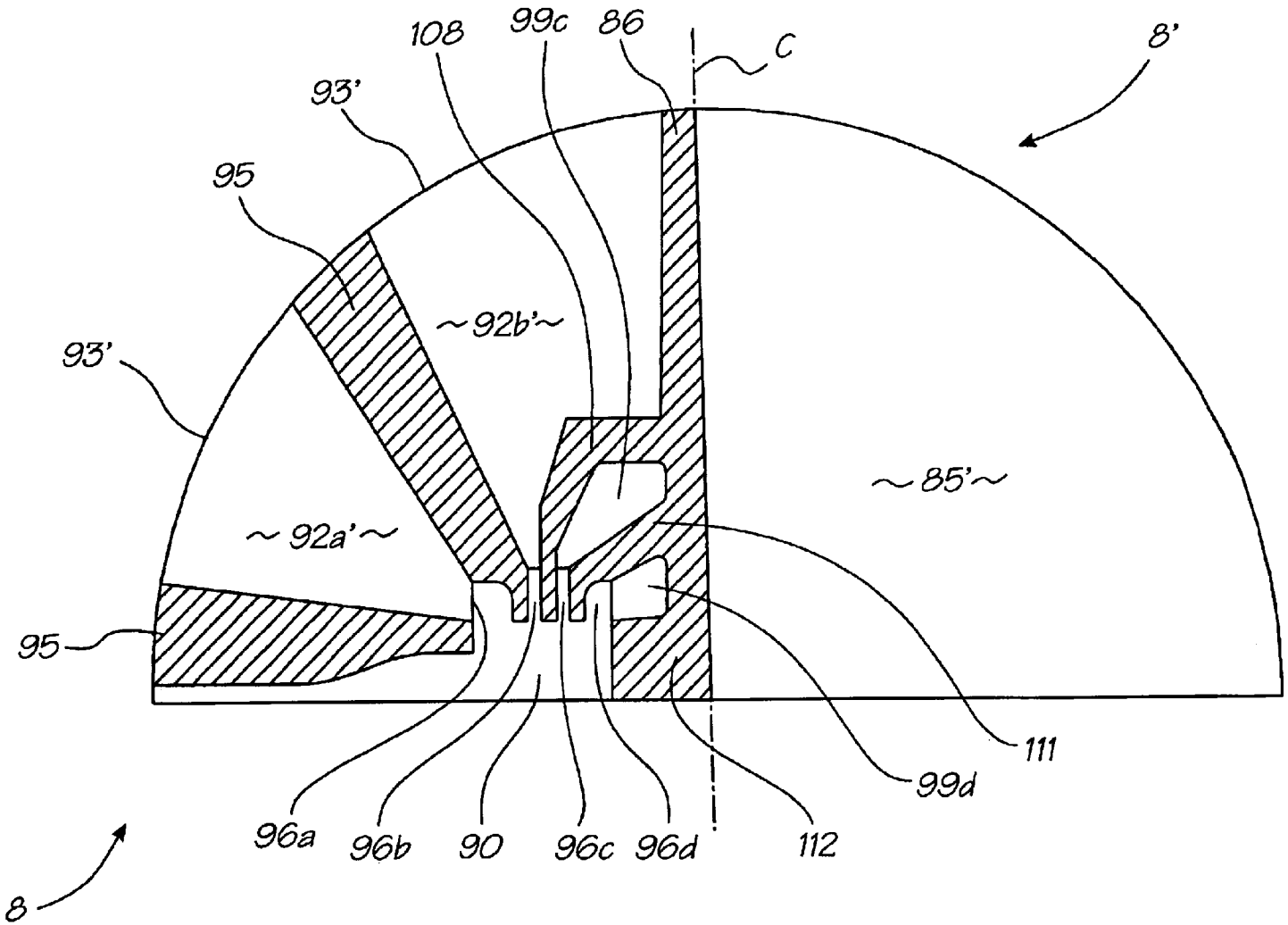
FIG. 12 is a cross-sectional view of the printhead carrier of FIGS. 6 and 7 taken at station "D—D" in FIG. 8.

FIG. 12 shows a cross-section through one of the lengthwise end portions of longer quarter cylinder section 8" of carrier 8. By comparison with FIG. 11 (which shows a cross-section through the main body of carrier 8), it will be seen that the quasi-radially extending walls 95 bordering end gallery 92*a*' have the same shape as walls 95 which border galleries 92*a*, whereas gallery 92*b*' is bounded on one side by intermediate step wall 86 and by a wall 108. FIG. 12 also shows a wall 111 and a wall formation 112 on the wall 86, the purpose of which is explained below.

Converging walls 95 are so shaped at their radially inner ends as to define four ink delivery slots 96*a* to 96*d* which extend lengthwise in the carrier 8 and which open into the recess 90, as best seen in FIGS. 11 and 11*a*. The slots 96*a* to 96*d* extend between the opposite end walls 84 of longer quarter cylinder section 8" and pierce through the inner parallel walls 97, including the endwise opposite walls 97 which form the end walls 85 of the shorter cylinder section 8'. FIG. 12 shows how slots 96*a* to 96*d* extend and are formed within the end portions of the longer quarter cylinder section 8', where the slots 96*a* to 96*d* are defined by the terminal ends of two of walls 95, walls 108, 111 and wall formation 112, wall formation 112 in effect being a perpendicular lip of intermediate step wall 86.

The widths and transverse positioning of the ink delivery slots 96*a* to 96*d* are such that when a printhead segment 4 is received in recess 90, a respective one of the slots 96*a*–96*d* will be in fluid communication with one only of four lengthwise oriented rows of ink supply holes 41 on rear face 42 of printhead segment 4, compare FIG. 11*a*. Each row of ink supply holes 41 corresponds to a row of printhead nozzles 43 running lengthwise along the front face 44 of printhead segment 4. In the schematic representation of segment 4 in FIG. 11*a*, the positions of holes 41 and nozzles are indicated by dots, with no attempt made to show their actual construction. Reference to PCT Application No. PCT/AU98/00550 will provide further details of the make-up of segment 4. Accordingly, each of the ink galleries of a specific gallery row 92*a* to 92*d* is in fluid communication with one only of the rows of ink supply holes 41. Once a printhead segment 4 is form fittingly received in recess 90 and sealingly secured with its rear face 42 against the terminal inner ends of walls 95, and wall formations 108, 111 and 112 (using a suitable sealant or adhesive), cross-communication and ink bleeding between slots 96*a*–96*d* via recess 90 is not possible.

When a carrier 8 is installed in its correct position lengthwise in the slot 21 of profile 10, compare FIG. 3, each opening 93 in its back face 91 aligns with one of the openings 26 in the shim 25. Smaller openings 26' in the shim 25 correspond to openings 93' of the smaller galleries 92*a*' and 92*b*' of carrier 8. Therefore, each one of the ink supply channels 20*a* to 20*d* is in fluid communication with one only of the rows of ink galleries 92*a* to 92*d*, respectively, and so with one only of the slots 96*a* to 96*d* respectively and only one of the rows of ink supply holes 41. A suitable glue or sealant is provided at mating surfaces of the shim 25 and the carrier 8 to prevent leakage of ink from any of the channels 20*a* to 20*d* to an incorrect one of the galleries 92, as described further below. The symmetrical location (mentioned above) of openings 93 on back face 91 of carrier 8, which is matched by the openings 26 in shim 25, enables the carrier 8 to be received in the slot 21 in either of the two orientations shown in FIG. 3, with in both cases each row of ink galleries 92*a* to 92*d* aligning with one only of the ink supply channels 20*a* to 20*d* .

As mentioned above, the longer quarter cylinder section 8" of carrier 8 has two galleries 92*a*' and 92*b*' at each lengthwise end that have no counterpart in the shorter section 8'. These galleries 92*a*' and 92*b*' provide direct ink supply paths to that part of their associated ink delivery slots 96*a* and 96*b* located in the longer quarter cylinder section 8", and thus to the ink supply holes 41 of the printhead segment 4 that are located near the lengthwise terminal ends of segment 4 when secured within recess 90. There are no corresponding quasi-radial galleries to supply ink to the end regions of the slots 96*c* and 96*d*. However, it is desirable to provide direct ink supply to the end portions of the other two slots 96*c* and 96*d* as well, without reliance on lengthwise flow within the slots 96*c* and 96*d* of ink that has passed through galleries 92*c* and 92*d* respectively. This is ensured by provision of ink supply chambers 99*c* and 99*d* which are shown in FIG. 12 and which supply ink to the slots 96*c* and 96*d*, respectively. Chambers 99*c* and 99*d* are bounded by the walls 84, 86, and wall formations 108, 111 and 112, are open towards slots 96*c* and 96*d*, respectively, and are in fluid communication through holes 113 and 114 in an endmost wall 97 with endmost ones of ink galleries 92*c* and 92*d*, respectively. The holes 113 and 114 have outlines shaped to match the transverse cross-sectional shapes of the chambers 99*c* and 99*d*, respectively, as shown in FIG. 12, and the means whereby holes 113 and 114 are formed is described below.

Figure 13:
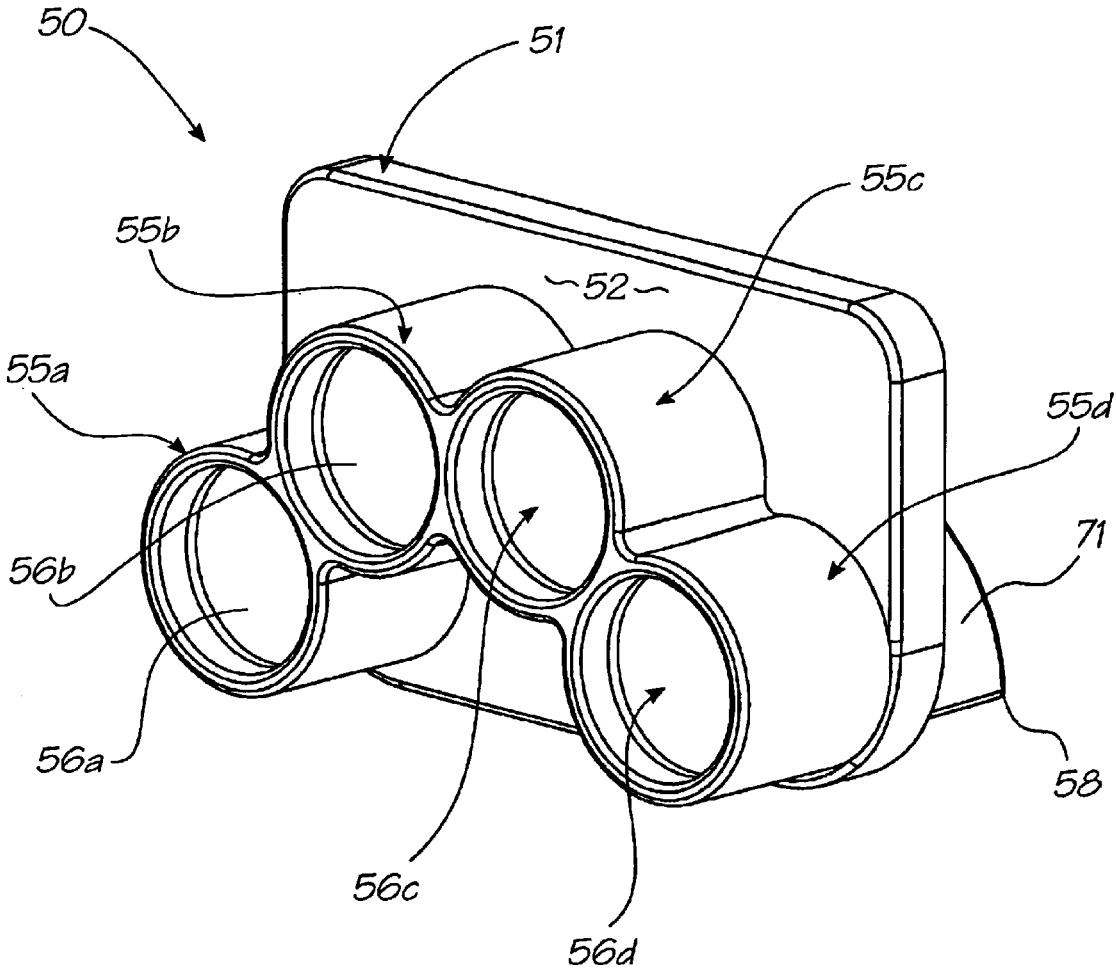
FIG. 13 is an external perspective view of an end cap of the inkjet printhead assembly shown in FIG. 1.
Figure 14:
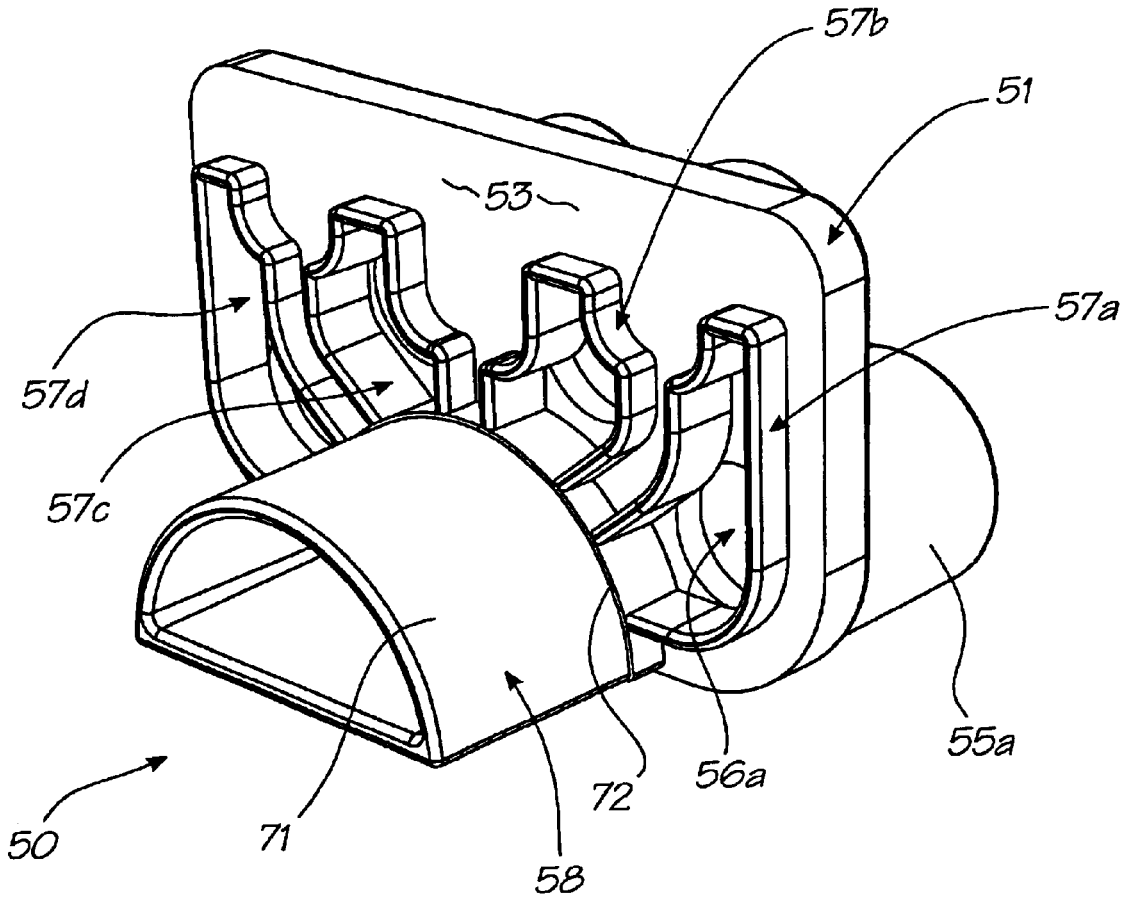
FIG. 14 is an internal perspective view of the end cap shown in FIG. 13

FIGS. 13 and 14 show a first end cap 50 which is sealingly secured to an open terminal longitudinal end of profile member 10, as may be seen in FIGS. 1 and 2. Cap 50 is molded from a plastics material and it incorporates a generally planar wall portion 51 that extends perpendicularly to a lengthwise axis of profile member 10. Four tubular stubs 55*a*–55*d* are integrally moulded with planar wall portion 51 on side 52 of wall portion 51 which will face away from support profile 10 when end cap 50 is secured thereto. On the planar wall side 53 which will face the longitudinal terminal end of support profile 10 (see FIG. 14), four hollow-shaped stubs 57*a*–57*d* are integrally moulded with planar wall portion 51. As best seen in FIG. 14, ink supply conduits 56*a* to 56*d* are defined within tubular stubs 55*a* to 55*d* respectively, extend through planar wall portion 51, and open within shaped stubs 57*a* to 57*d*, respectively, located on the other sides of cap 50.

The shape of each one of the insert stubs 57*a* to 57*d*, as seen in transverse cross-section, corresponds respectively to one of the ink supply channels 20*a* to 20*d* of support profile so that, when cap 50 is secured to the terminal axial end of support profile 10, the walls of stubs 57*a*–57*d* are received form-fittingly in ink supply channels 20*a*–20*d* to prevent cross-migration of ink therebetween. The face 53 abuts a terminal end face of the profile 10. Preferably, glue or a sealant can be applied to the mating surfaces of profile 10 and cap 50 to enhance the sealing function.

The tubular stubs 55*a*–55*d* serve as female connectors for pliable/flexible ink supply hoses (not illustrated) that can be connected thereto sealingly, thereby to supply ink to the integral ink supply channels 20*a*–20*d* of support profile 10.

A further stub 58, D-shaped in transverse cross-section, is integrally moulded to planar wall portion 51 at side 53. In completed assembly 1, the curved wall 71, semi-circular in transverse cross-section, of retaining stub 58 seals against the inside surface of shim 25, with the terminal edge of shim 25 61 abutting a peripheral ridge 72 around the stub 58. Preferably, to avoid cross-migration of ink among channels 20*a* to 20*d*, an adhesive or sealant is provided between the shim 25 and wall 71. The stub 58 assists in retaining the shim 25 in slot 21.

Figure 15:
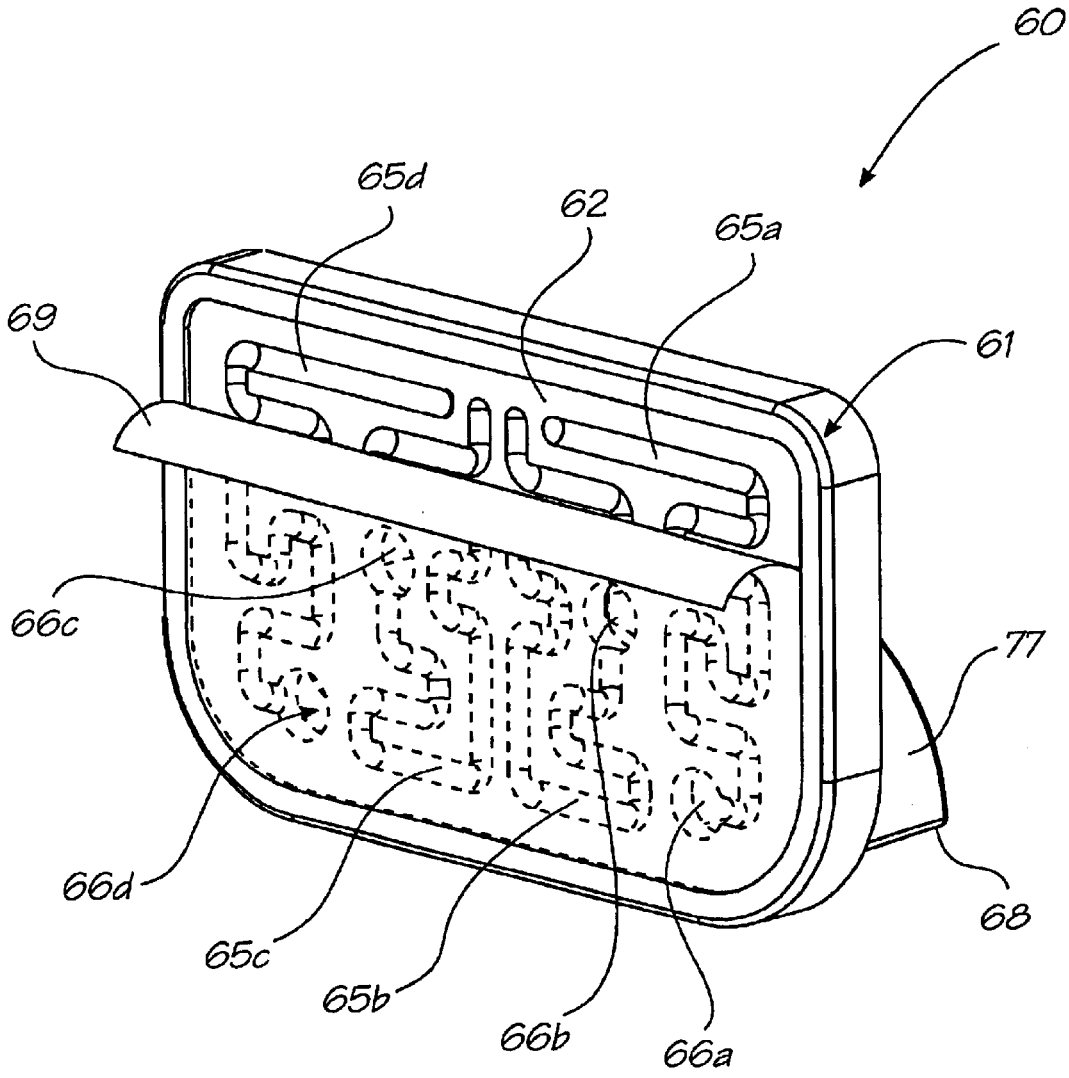
FIG. 15 is an external perspective view of a further end cap of the inkjet printhead assembly shown in FIG. 1.
Figure 16:
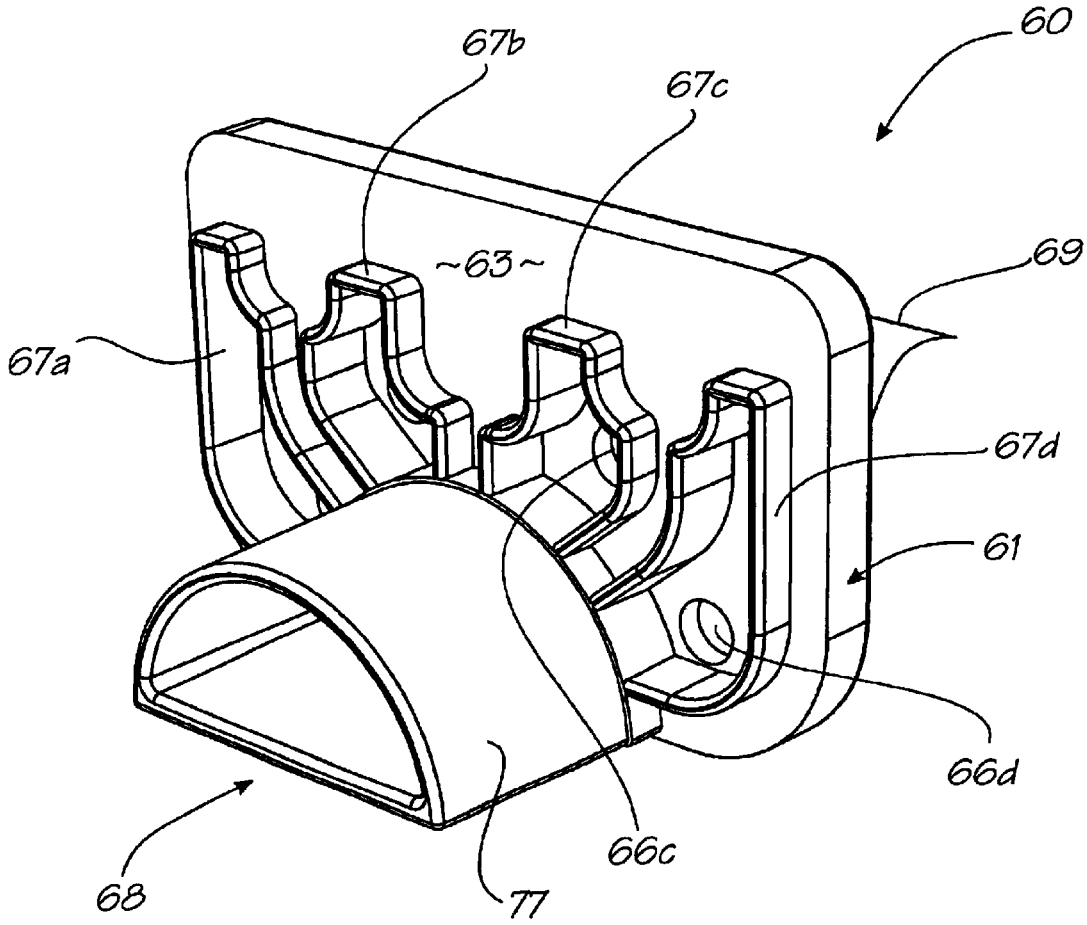
FIG. 16 is an internal perspective view of the end cap shown in FIG. 15.

A second end cap 60, which is shown in FIGS. 15 and 16, is mounted to the other end of the profile 10 opposite to cap 50. Cap 60 has insert stubs 67*a* to 67*d* and a retaining stub 68 identical in arrangement and shape to stubs 57*a* to 57*d* and stub 58, respectively, of end cap 50. Insert stubs 67*a* to 67*d* and retention stub 68 are integrally moulded with a planar wall portion 61, and in the completed assembly 1 seal off the individual ink supply channels 20*a*–20*d* from one another, to prevent cross-migration of ink among them. Wall 77 of the retention stub 68 abuts the shim 25 in the same way as described above. A sealant or adhesive is preferably used with end cap 60 in the same way (and for the same purpose) as described above in respect of end cap 50.

Whereas end cap 50 enables connection of ink supply hoses to the printhead assembly 1, end cap 60 has no tubular stubs on exterior face 62 of planar wall portion 61. Instead, four tortuous grooves 65*a* to 65*d* are formed on exterior face 62, and terminate at holes 66*a* to 66*d*, respectively, extending through wall portion 61. Each one of holes 66*a* to 66*d* opens into a respective one of the channels 20*a* to 20*d* so that when the cap 60 is in place on the profile 10, each one of the grooves 65*a* to 65*d* is in fluid communication with a respective one of the channels 20*a* to 20*d*. The grooves 65*a*–65*d* permit bleeding-off of air during priming of the printhead assembly 1 with ink, as holes 66*a*–66*d* permit air expulsion from the ink supply channels 20*a*–20*d* of support profile 10 via grooves 65*a*–65*d*. Grooves 65*a*–65*d* are capped under a translucent plastic film 69 bonded to outer face 62. Translucent plastic film 69 thus also serves the purpose of allowing visual confirmation that the ink supply channels 20*a*–20*d* of profile 10 are properly primed. For charging the ink supply channels 20*a*–20*d* with ink, film 69 is folded back (as shown in FIG. 15) to partially uncover grooves 65*a*–65*d*, so that displaced air may bleed out as ink enters the grooves 65*a*–65*d* through holes 66*a*–66*d*. When ink is visible behind film 69 in each groove 65*a*–65*d*, film 69 is folded towards face 62 and bonded against face 62 to sealingly cover face 62 and so cap-off grooves 65*a*–65*d* and isolate them from one another.

Figure 17:
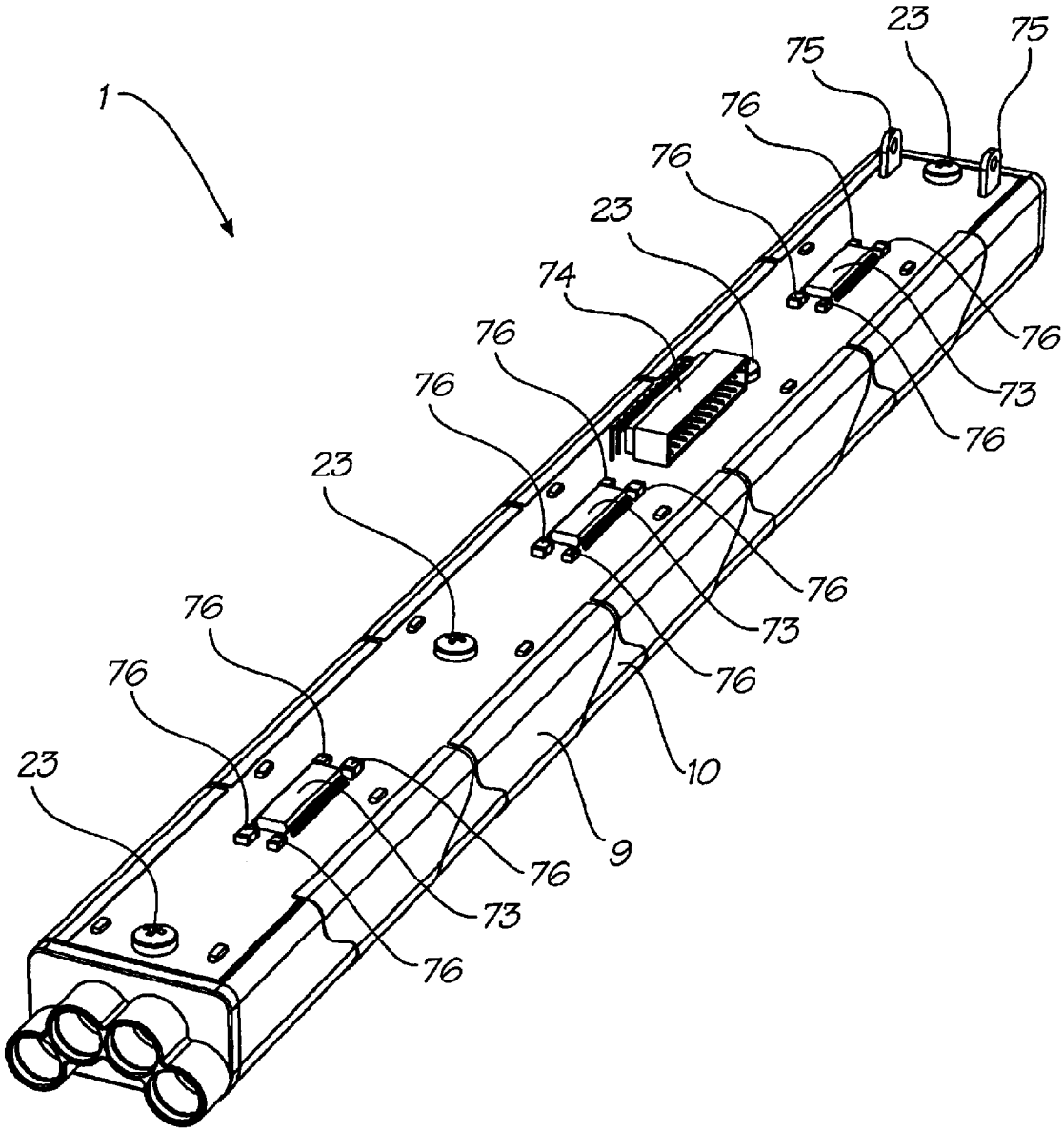
FIG. 17 is a perspective view (from the bottom) of the printhead assembly shown in FIG. 1.

Referring to FIG. 17 (and see also FIGS. 3 and 4), the printed circuit board (PCB) 11 locates between edges 24 formed on profile 10, and is secured by screw fasteners 23 which engage with the serrations in elongate channel 22 of support profile 10. The PCB 11 contains three surface mounted halftoning chips 73, a data connector 74, printhead power and ground busbars 75 and decoupling capacitors 76. Side walls 16, 17 of support profile 10 are rounded near the edges 24 to avoid damage to the TAB films 9 when these are wound about profile 10. The electronic components 73 and 76 are specific to the use of MEMJET chips as the printhead segments 4, and would of course, if other another printhead technology were to be used, be substituted with other components as necessitated by that technology.

The shield plate 5 illustrated in FIG. 1, which is a thin sheet of stainless steel, is bonded with sealant such as a silicon sealant onto the printhead segment carriers 8. The shield plate 5 shields the TAB films 9 and the printhead segments 4 from physical damage and also serves to provide an airtight seal around the printhead segments 4 when the assembly 1 is capped during idle periods.

The multi-part layout of the printhead assembly 1 that has been described in detail above has the advantage that the printhead segment carriers 8, which interface directly with the printhead segments 4 and which must therefore be manufactured with very small tolerances, are separate from other parts, including particularly the main support frame (profile 10) which may therefore be less tightly toleranced. As noted above, the printhead segment carriers 8 are precision injection micro-moldings. Moldings of the required size and complexity are obtainable using existing micromolding technology and plastics materials such as ABS, for example. Tolerances of +/−10 microns on specified dimensions are achievable including the ink supply grooves 96*a*–96*d*, and their relative location with respect to the recess 90 in which the printhead segments 4 are received. Such tolerances are suitable for this application. Other material selection criteria are thermal stability and compatibility with other materials to be used in the assembly 1, such as inks and sealants. The profile 10 is preferably an aluminum alloy extrusion. Tolerances specified at +/−100 microns have been found suitable for such extrusions, and are achievable as well.

Figure 19:
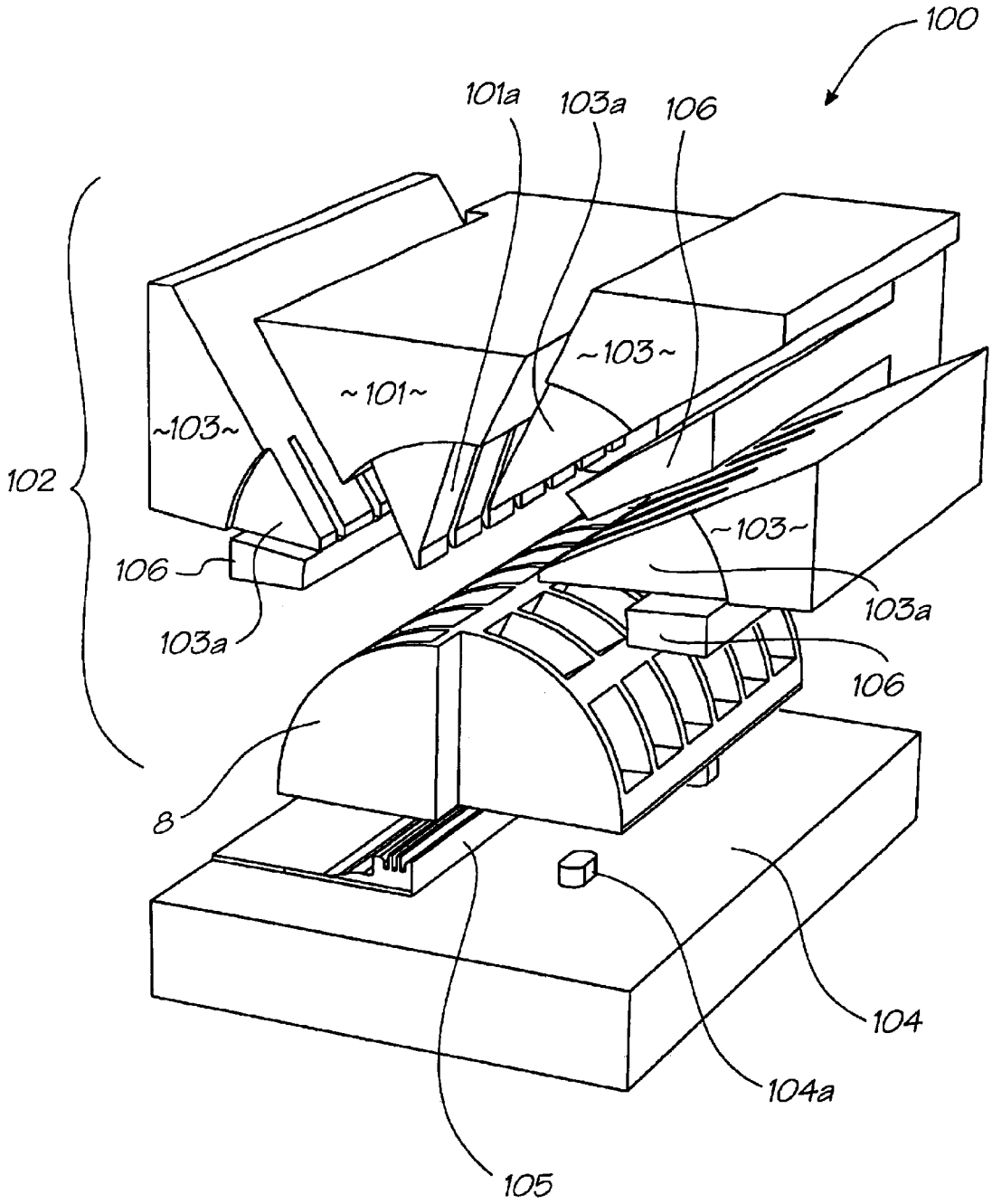
FIG. 19 is a perspective view showing a molding tool and illustrating the basic arrangement of die components for injection molding of the printhead carrier shown in FIGS. 6 and 7.
Figure 20:
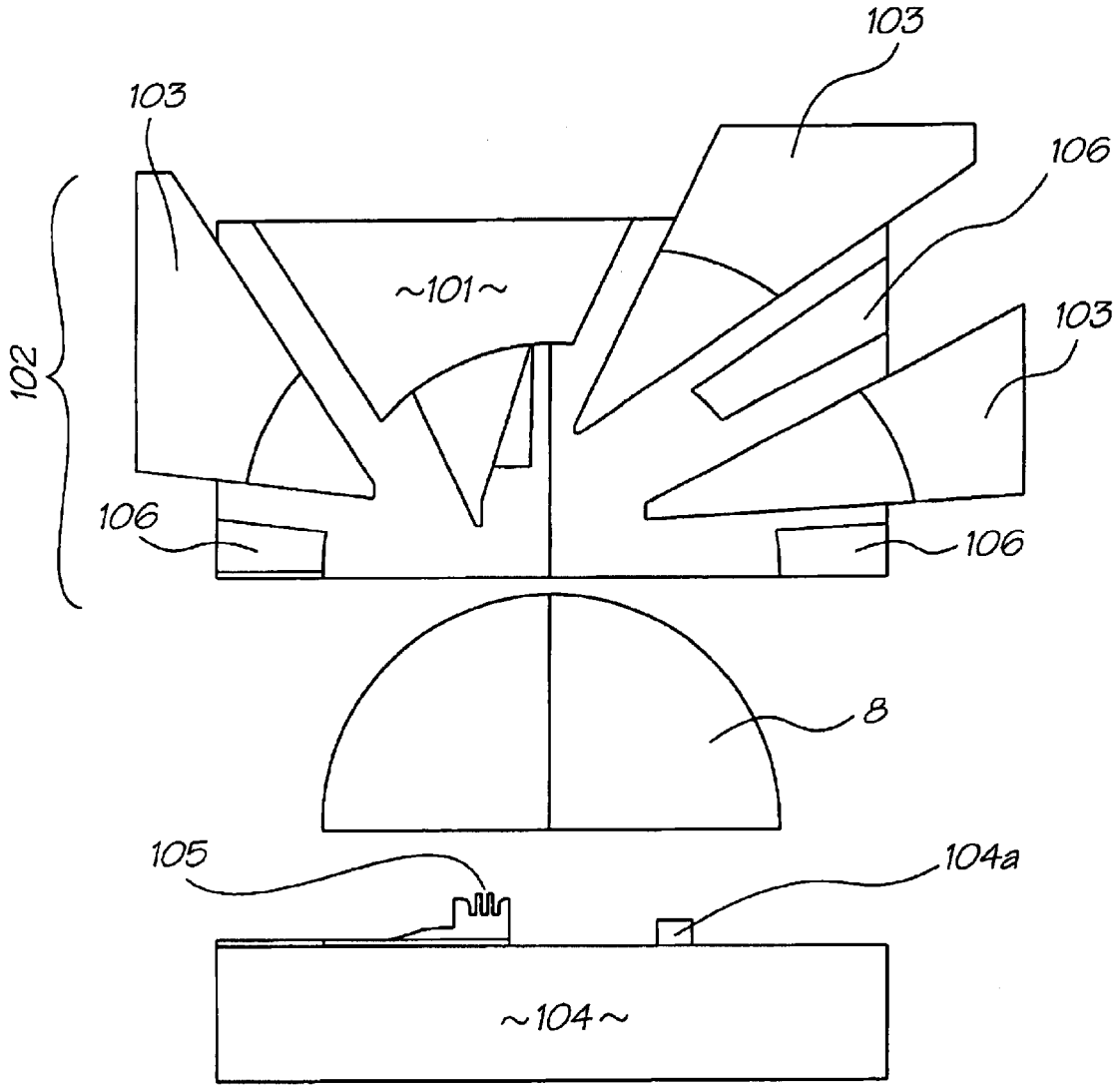
FIG. 20 is a schematic cross-section of the injection molding tool shown in FIG. 19, in an open position.
Figure 21:
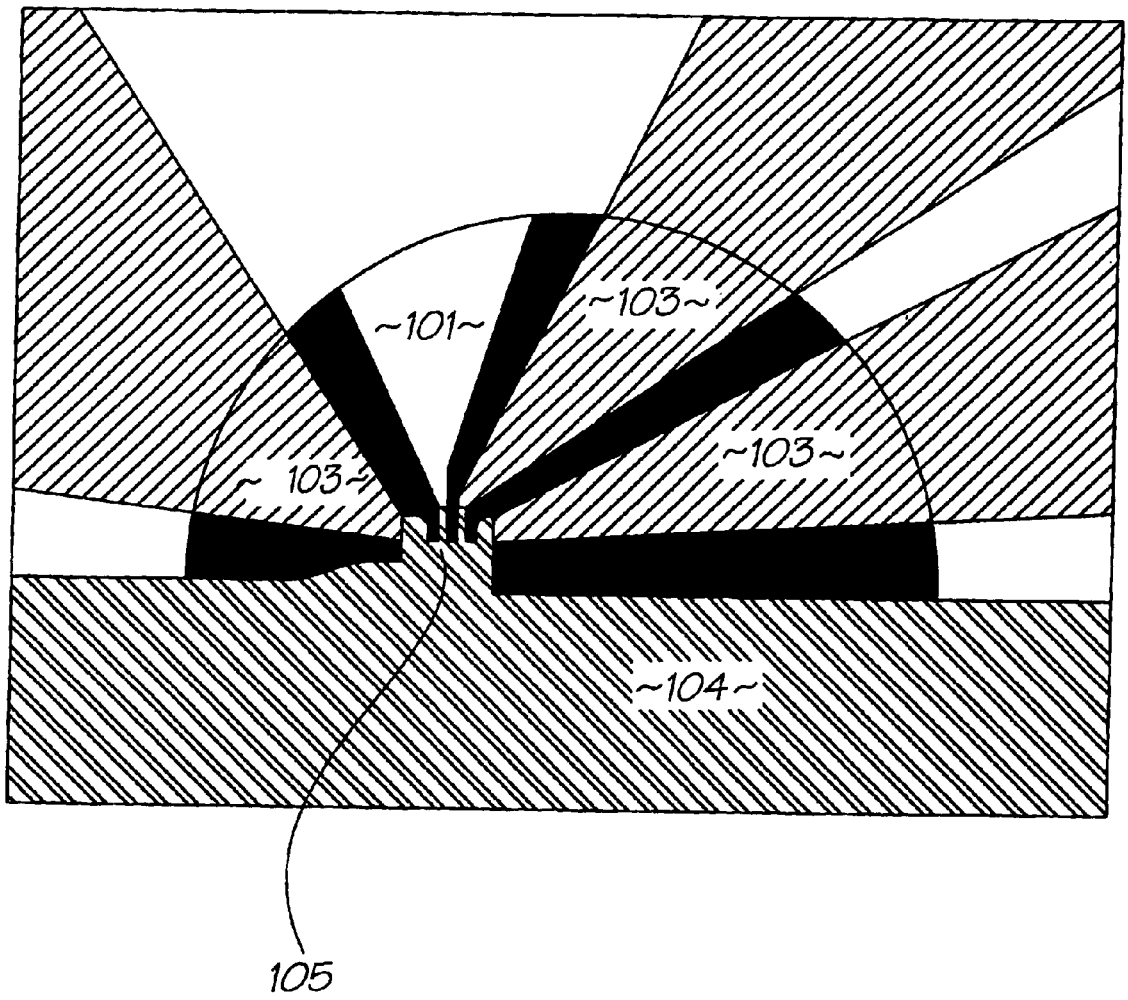
FIG. 21 is a schematic transverse cross-section of the injection molding tool shown in FIG. 19, in a closed position, taken at a station corresponding to the station "A—N" in FIG. 8.

FIGS. 19, 20 and 21 are schematic representations only, intended to provide an understanding of the construction of an injection molding die used in the manufacture of a printhead segment carrier 8. A multi-part die 100 is used, having a fixed base die part 104, which in use defines the face 82, recess 90 and slots 96*a* to 96*d* of the carrier 8, and a multi-part upper die part 102. The upper die part 102 is closed against the base part 104 for molding, and includes a part 101 with multiple fingers 101*a* which in use form the galleries 92*b* (including galleries 92*b*'). and parts 106 which are fixed relative to part 101. Also included in the upper part 102 are die parts 103 which are movable relative to the part 101 and which have fingers 103*a* to form the remaining galleries 92*a*, 92*c* and 92*d*. Parts 103 seat against parts 106 when molding is underway. Spaces between the fingers 101*a* and 103*a* correspond to the walls 97. In use of the die 100, terminal tips of the fingers 101*a* and 103*a* close against blades 105 which in use form the ink supply slots 96*a*–96*d* of carrier 8 and which are mounted to male base 104 to be detachable and replaceable when necessary. Base die part 104 also has inserts 104*a* which in use form the pickup slots 87. Because zero draft is preferred on the stepped end faces 83 in this application, the die 100 also has two movable end pieces (not shown, for clarity) which in use of the die 100 are movable generally axially to close against the upper die part 102 and which are shaped to define the end faces 84', 85' and 86' of carrier 8. FIG. 21 shows a schematic transverse cross-section of the mold 100 when closed, with areas in black corresponding to the carrier 8 being molded.

As was mentioned above, the two opposite end portions of the larger quarter cylinder section 8 of carrier 8 incorporate two ink supply chambers 99*c* and 99*d* (see FIG. 12) to provide ink to the ink supply slots 96*c* and 96*d* in that region of the carrier 8. These chambers 99*c* and 99*d* and associated communication holes 113 and 114 in parallel walls 97 that lead into the neighbouring galleries 92*c* and 92*d*, are formed in an operation subsequent to molding, by laser cutting openings of the required shape in the end walls 84 and the neighbouring inner parallel walls 97 from each end. The openings cut in end walls 84 are only necessary so as to access the inner walls 97, and are therefore subsequently permanently plugged using appropriately shaped plugs 115 as shown in FIG. 6.

Extrusions usable for profile 10 can be produced in continuous lengths and precision cut to the length required. The particular support profile 10 illustrated is 15.4 mm×25.4 mm in section and about 240 mm in length. These dimensions, together with the layout and arrangement of the walls 16 and 17 and internal webs 14*a* to 14*c*, have been found suitable to ensure adequate ink supply to eleven (11) MEMJET printhead segments 4 carried in the support profile to achieve four-color printing at 120 pages per minute (ppm). Support profiles with larger cross-sectional dimensions can be employed for very long printhead assemblies and/or for extremely high-speed printing where greater volumes of ink are required. Longer support profiles may of course be used, but are likely to require cross-bracing and location into a more rigid chassis to avoid alignment problems of individual printhead segments, for example in the case of a wide format printer of 54" (1372 mm) or more.

An important step in manufacturing (and assembling) the assembly 1 is achieving the necessary, very high level of precision in relative positioning of the printhead segments 4, and here too the construction of the assembly 1 as described above is advantageous. A suitable manufacturing sequence that ensures such high relative positioning of printheads on the support profile will now be described.

After manufacture and successful testing of an individual printhead segment,4, its associated TAB film 9 is bumped and then bonded to bond pads along an edge of the printhead segment 4. That is, the TAB film is physically secured to segment 4 and the necessary electrical connections are made. The terms "bumped" and "bonded" will be familiar to persons skilled in the arts where TAB films are used. The printhead carrier 8 is then primed with adhesive on all those surfaces facing into recess 90 that mate and must seal with the printhead segment 4, see FIG. 11*a*, i.e. along the length of the radially-inner edges of walls 95, 108 and 111, the face of formation 112 and on inner faces of walls 84. The printhead segment 4 is then secured in place in recess 90 with its TAB film 9 attached. Extremely accurate alignment of the printhead segment 4 within recess 90 of printhead segment carrier 8 is not necessarily required (but is preferred), because relative alignment of all segments 4 at the support profile 10 is carried out later, as is described below. The assembly of the printhead segment 4, printhead segment carrier 8 and TAB film 9 is preferably tested at this point for correct operation using ink or water, before being positioned for placement in the slot 21 of support profile 10.

The support profile 10 is accurately cut to length (where it has been manufactured in a length longer than that required, for example by extrusion), faced and cleaned to enable good mating with the end caps 50 and 60.

A glue wheel is run the entire length of semi-circular slot 21, priming the terminal edges 14*a*', 14*b*', 14*c*' of webs 14*a*–14*c* and edges 16', 17' of profile side walls 16, 17 with adhesive that will bond the sealing shim 25 into place in slot 21 once sealing shim 25 is placed into it with preset distance from its terminal ends (+/−10 microns). The shim 25 is snap-fitted into place at edges 16', 17' and the glue is allowed to set. Next, end caps 50 and 60 are bonded into place whereby (ink channel sealing) insert stubs 57*a*–57*d* and 67*a*–67*d* are received in ink channels 20*a*–20*d* of profile 10, and faces 71 and 77 of retention stubs 58 and 68, respectively, lie on shim 25. This sub-assembly provides a chassis in which to successively place, align and secure further sub-assemblies (hereinafter called "carrier subassemblies") each consisting of a printhead segment carrier 8 with its respective printhead segment 4 and TAB film 9 already secured in place thereon.

A first carrier sub-assembly is primed with glue on the back face 91 of its printhead segment carrier 8. At least the edges of walls 95 and 86, are primed. A glue wheel, running lengthwise, is preferably used in this operation. After priming with glue, the carrier sub-assembly is picked up by a manipulator arm engaging into pick-up slots 87 on front face 82 of carrier 8 and placed next to the stub 58 of end cap 50 (or the stub 68 of cap 60) at one end of slot 21 in profile 10. The glue employed is of slow-setting or heat-activatable type, thereby to allow a small level of positional manipulation of each carrier subassembly, lengthwise in the slot 21, before final setting of the glue. With the first carrier subassembly finally secured to the shim 25 within the slot 21, a second carrier sub-assembly is then picked up, primed with glue as above, and placed in a 180-degree-rotated position (as described above, and as may be seen in FIG. 3) next to the first carrier sub-assembly onto shim 25 and within the slot 21. The second carrier sub-assembly is then positioned lengthwise so that there is correct lengthwise relative positioning of its printhead segment 4 and the segment 4 of the previously-placed segment 4, as determined using suitable fiducial marks (not shown) on the exposed front surface 44 of each of the printhead segments 4. That is, lengthwise alignment is carried out between successive printhead segments 4, even though it is the printhead segment carrier 8 that is actually manipulated. This relative alignment is carried out to such (sub-micron) accuracy as is required to match the printing resolution capability of the printhead segments 4. Finally, the bonding of the second carrier sub-assembly to shim 25 is completed. The above process is then repeated with further carrier subassemblies being successively positioned, aligned, and bonded into place, until all carrier subassemblies are in position within the slot 21 and bonded in their correct positions.

The shield plate 5 has a thin film of silicon sealant applied to its underside and is mated to the printhead segment carriers 8 and TAB films 9 along the entire length of the printhead assembly 1. By suitable choice of adhesive properties of the silicon sealant, the shield plate 5 can be made removable to enable access to the printhead segment carriers 8, printhead segments 4 and TAB films 9 for servicing and/or exchange.

A sub-assembly of PCB 11 and printhead control and ancillary components 73 to 76 is secured to profile 10 using four screws 23. The TAB films 9 are wrapped around the exterior walls 16, 17 of profile 10 and are bumped and bonded (i.e. physically and electrically connected) to the PCB 11. See FIG. 17.

Finally, the completed assembly 1 is connected at the ink inlet stubs 55*a*–*d* of end cap 50 to suitable ink supplies, primed as described above and sealed using sealing film 69 of end cap 60. Power and signal connections are completed and the inkjet printhead assembly 1 is ready for final testing and subsequent use.

Figure 18:
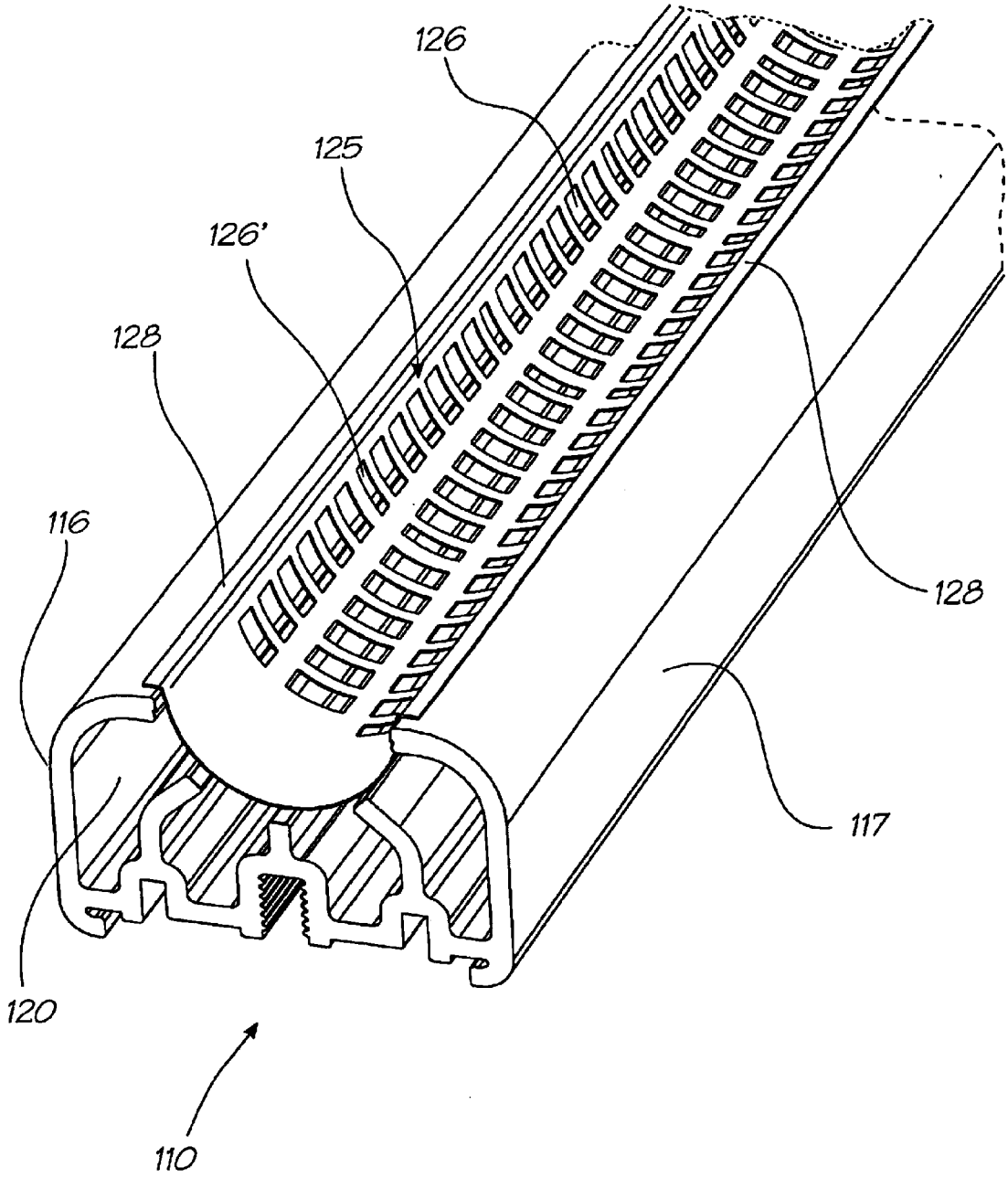
FIG. 18 is a perspective view of a part assembly of a support profile and modified sealing shim which are alternatives to those shown in FIGS. 4 and 5.

It will be apparent to persons skilled in the art that many variations of the above-described assembly and components are possible. For example, FIG. 18 shows a shim 125 that is substantially the same as shim 25, including having openings 126 and 126' corresponding to the openings 26 and 26' in shim 25, save for longitudinally extending rim webs 128 which, when the shim 125 is mounted to a support profile 110, abut in surface-engaging manner against the outside of the terminal ends of side walls 116, 117 of profile 110 instead of being snap-fittingly received between them as is the case with shim 25. This arrangement permits wider tolerances to be used in the manufacture of the support profile 110 without compromising the mating capability of the shim 125 and the profile 110.

In yet another possible arrangement, the shim 25 could be eliminated entirely, with the printhead segment carriers 8 then bearing and sealing directly on the edges 14*a*'–14*c*' and 16', 17' of the webs 14*a*–14*c* and side walls 16, 17 at slot 21 of support profile 10.

It will be appreciated by persons skilled in the art that still further variations and modifications may be made without departing from the scope of the invention. The embodiments of the present invention as described above are in no sense intended to be restrictive.

What is claimed is:

1. A support for a plurality of inkjet printhead segments, said support including:

a hollow elongate member having at least one ink supply channel formed therein, the or each ink supply channel being in fluid communication with an elongate slot in and extending at least partly along the elongate member; a plurality of printhead segment carriers received and secured in neighbouring arrangement within the slot, each printhead segment carrier being adapted for mounting thereto of at least one printhead segment, and including at least one ink gallery arranged so as to connect the or an associated one of said ink supply channels with an ink inlet of said at least one printhead segment when mounted to the printhead segment carrier; and a shim that is received in the slot in the elongate member to lie between the elongate member and said printhead segment carriers, said shim having at least one aperture therein to permit flow of ink between the or an associated one of said ink supply channels and a corresponding one ink gallery of the respective printhead segment carrier.

2. A support according to claim 1, wherein when mounted to the support the at least one printhead segment on each printhead segment carrier has a defined printing range in a direction lengthwise along the elongate member, and wherein the printing ranges or the printhead segments mountable to a plurality of adjoining printhead segment carriers overlap, thereby to define a combined printing range of greater lengthwise extent than any of the printing ranges comprised therein.

3. A support according to claim 1, wherein the printhead segment carriers are substantially identical to one another and have stepped terminal ends thereby to enable neighbouring pairs of printhead carriers to be mounted within the slot in orientations substantially oppositely to one another in a direction transverse to the elongate member.

4. A support according to claim 3, wherein each stepped terminal end of a carrier includes inner and outer end faces extending substantially transversely within the slot from points at least approximately midway across the slot, said inner and outer end faces being spaced apart in a direction along the slot, and wherein said terminal ends are shaped mirror-symmetrically so that the outer end faces are further apart in a direction along the elongate member than the inner end faces.

5. A support according to claim 4, wherein each printhead segment carrier has an elongate recess in an external surface of the carrier within which at least one printhead segment is received when mounted to the printhead segment carrier and wherein said recess extends along the carrier between ends each located longitudinally between said end faces of a terminal end, whereby recesses of neighbouring pairs of carriers overlap in a direction along the elongate member.

6. A support according to claim 5, wherein opening into said recess of each printhead segment carrier is at least one elongate ink delivery slot extending therealong, the or each of which is in fluid communication with only said ink supply channel via the or said ink gallery extending from said at least one ink slot to an opening in a rear face within the slot of the printhead segment carrier.

7. A support according to claim 6, wherein in fluid communication with the or each ink delivery slot, there is a plurality of said ink galleries and said openings and wherein said openings associated with the or each said ink delivery slot are arranged in a row extending in a direction along the elongate member.

8. A support according to claim 7, having a plurality of ink supply channels and in each printhead segment carrier a plurality of said rows of openings, each row being aligned along its length with one said ink channel for passage of ink from said ink channel through said row of openings.

9. A support according to claim 8, wherein between the inner end faces of each printhead segment carrier, boundaries of the ink galleries are defined by a plurality of parallel walls extending transversely in the carrier and intersecting therewith a plurality of converging walls extending from the rear face to shaped inner edges which at least partially define the ink delivery slots.

10. A support according to claim 8, wherein at each terminal end of each printhead segment carrier at least one said ink gallery is defined between the inner and outer end faces at that terminal end by walls extending transversely in the carrier and, intersecting therewith, a plurality of converging walls extending from the rear face to shaped inner edges which at least partially define parts of the ink delivery slots between said inner and outer end faces.

11. A support according to claim 1, wherein the shim and the slot are substantially semi-circular in cross-sectional shape.

12. A support according to claim 1, wherein the shim and/or the elongate member comprise means for snap-fittingly mounting said shim at said slot.

13. A support according to claim 1, wherein the shim is adhesively bonded to mating surfaces of the elongate member.

14. A support according to claim 1, wherein the printhead segment carriers are adhesively bonded to the shim.

15. A support according to claim 1, wherein edges extending in a direction along the shim are attached to webs which abut external surfaces of the elongate member.

16. A support according to claim 1 wherein each printhead segment carrier has a recess formed in an external surface thereof within which at least one printhead segment is received when mounted to the printhead segment carrier and wherein said external surface has a second recess formed therein and adapted to receive at least a part of a power or signal conductor terminating on the or one said printhead segment mounted to the printhead segment carrier.

17. A support according to claim 16, wherein said conductor comprises a tape automated bonded (TAB) film.

18. A support according to claim 17, wherein said tape automated bonded film (TAB) is wrapped around an external surface of the elongate member and terminated on a printed circuit board secured to a side of the elongate member opposite to the printhead segment to which it is connected.

19. A support according to claim 1, further including a first cap secured to a first terminal end of the elongate member and having an ink inlet port in fluid communication with the or an associated one of said ink supply channels.

20. A support according to claim 19, further including a second cap secured to a second terminal end of the elongate member and having an opening for bleeding of air from the or an associated one of said ink supply channels, said support further including means for sealing off said opening after such bleeding.

21. A support according to claim 20, wherein said second cap includes an outer face with a tortuous channel formed therein, said tortuous channel being in fluid communication with said opening and wherein said sealing means includes a film removable at least in part from the outer face and adapted to adhere to the outer face thereby to cover the tortuous channel and seal off the opening.

22. A support according to claim 1, further including an external protective shield plate covering the printhead segment carriers and having openings arranged to permit unimpeded passage of ink ejected from nozzles of printhead segments mounted to the carriers towards a surface passing beneath the support.

23. A support according to claim 1, wherein the elongate member has three, four or six of said ink supply channels, one each for a preferably differently colored ink.

24. A support according to claim 1, wherein each printhead segment carrier is mounted within the slot at a longitudinal position within a predetermined tolerance distance of a designated longitudinal position of the carrier corresponding to a designated longitudinal position within the slot of a printhead segment when mounted to said printhead segment carrier.

25. A support according to claim 1, wherein the elongate member is of substantially constant cross-sectional shape along its entire length.

26. A support according to claim 1, wherein in cross-section the elongate member includes a peripheral structured wall including a base wall section, and side wall sections standing out from opposing edges of said base wall section, and wherein said slot lies between free edges of said side wall section.

27. A support according to claim 26, wherein said elongate member further includes at least one internal web standing out from the base wall section and extending along said elongate member.

28. A support according to claim 27, wherein said elongate member has a plurality of said internal webs and wherein in cross-section said free edges of the side wall sections and free edges of said internal webs lie on a semicircle and define boundaries of said slot so that said slot is of semicircular cross-section.

29. An inkjet printhead assembly including:

a hollow elongate member having at least one ink supply channel formed therein, the or each ink supply channel being in fluid communication with an elongate slot in and extending at least partly along the elongate member; and a plurality of printhead segment carriers received and secured in neighbouring arrangement within the slot;

at least one printhead segment mounted to each printhead segment carrier, each printhead segment carrier including at least one ink gallery arranged so as to connect the or an associated one of said ink supply channels with an ink inlet of the at least one printhead segment mounted to the printhead segment carrier; and a shim that received in the slot in the elongate member and lies between the elongate member and said printhead segment carriers, said shim having at least one aperture therein to permit flow of ink between the or an associated one of said ink supply channels and a corresponding one ink gallery of the respective printhead segment carrier.

30. An inkjet printhead assembly according to claim 29, wherein the at least one printhead segment on each printhead segment carrier has a defined printing range in a direction lengthwise along the elongate member, and wherein the printing ranges of the printhead segments mounted to a plurality of adjoining printhead segment carriers overlap, so that the printhead segments mounted to said adjoining plurality of printhead segment carriers have a combined printing range of greater lengthwise extent than any of the printing ranges comprised therein.

31. An inkjet printhead assembly according to claim 29, wherein the printhead segment carriers are substantially identically to one another and have stepped terminal ends thereby to enable neighbouring pairs of printhead carriers to be mounted within the slot in orientations which are substantially opposite to one another in a direction transverse to the elongate member.

32. An inkjet printhead assembly according to claim 31, wherein each stepped terminal end of a carrier includes inner and outer end faces extending substantially transversely within the slot from points at least approximately midway across the slot, said inner and outer end faces being spaced apart in a direction along the slot, and wherein said terminal ends are shaped mirror-symmetrically to each other so that the outer end faces are further apart in a direction along the elongate member than the inner end faces.

33. An inkjet printhead assembly according to claim 32, wherein each printhead segment carrier has an elongate recess in an external surface of the carrier and the at least one printhead segment associated with the carrier is mounted in said recess, and wherein said recess extends along the carrier between said outer end faces of a terminal end, whereby said recesses of neighbouring pairs of carriers overlap in a direction along the elongate member.

34. An inkjet printhead assembly according to claim 31, wherein each printhead segment carrier has an elongate recess in an external surface of the carrier and the at least one printhead segment associated with the carrier is mounted in said recess, and wherein said elongate recesses of neighbouring printhead segment carriers overlap lengthwise.

35. An inkjet printhead assembly according to claim 29, wherein the shim and the slot are substantially semi-circular in cross-sectional shape.

36. An inkjet printhead assembly according to claim 29, wherein the shim and/or the elongate member comprise means for snap-fittingly mounting said shim at said slot.

37. An inkjet printhead assembly according to claim 29, wherein the shim is adhesively bonded to mating surfaces of the elongate member.

38. An inkjet printhead assembly according to claim 29, wherein the printhead segment carriers are adhesively bonded to the shim.

39. An inkjet printhead assembly according to claim 29, further including first and second end caps sealingly secured to respective terminal ends of the elongate member and wherein said shim abuts respective formations on said caps.

40. An inkjet printhead assembly according to claim 39, wherein said shim is adhesively bonded to said formation.

41. An inkjet printhead assembly according to claim 29, wherein each printhead segment carrier has an elongate recess in an external surface of the carrier and at least one of the printhead segments is mounted in said recess, wherein said external surface has a second recess formed therein and wherein at least a part of a power or signal conductor terminating on the or one said printhead segment mounted to the printhead segment carrier is received in said second recess.

42. An inkjet printhead assembly according to claim 41, wherein said conductor comprises a tape automated bonded (TAB) film.

43. An inkjet printhead assembly according to claim 41, wherein said conductor is wrapped around an external surface of the elongate member and terminated on a printed circuit board secured to a side of the elongate member opposite to the printhead segment to which it is connected.

44. An inkjet printhead assembly according to claim 29, further including a first cap secured to a first terminal end of the elongate member and having an ink inlet port in fluid communication with the or an associated one of said ink supply channels.

45. An inkjet printhead assembly according to claim 44, further including a second cap secured to a second terminal end of the elongate member and having an opening for bleeding of air from the or an associated one of said ink supply channels, said support further including means for sealing off said opening after such bleeding.

46. An inkjet printhead assembly according to claim 29, further including an external protective shield plate covering the printhead segment carriers and having openings arranged to permit unimpeded passage of ink ejected from nozzles of printhead segments mounted to the carriers towards a surface passing beneath said assembly.

47. An inkjet printhead assembly according to claim 29, wherein the elongate member has three, four or six of said ink supply channels one each for a preferably differently colored ink.

48. An inkjet printhead assembly according to claim 29, wherein each printhead segment carrier is mounted within the slot at a longitudinal position within a predetermined tolerance distance of a designated longitudinal position of the carrier corresponding to a designated longitudinal position within the slot of a printhead segment mounted to said printhead segment carrier.

49. An inkjet printhead assembly including:

a hollow elongate member of substantially constant cross-section along its length having a base wall, two sidewall sections standing out from the base wall, and at least one internal web extending inwardly from said base wall, said sidewall sections and webs defining a plurality of ink supply channels each in fluid communication with a slot extending along the member and free edges of said sidewall sections and said at least one internal web defining a periphery of a slot extending along the member;

a plurality of printhead segment carriers received and secured in neighbouring arrangement within the slot;

at least one printhead segment mounted to each printhead segment carrier; and means for connection of each said ink supply channels to a respective ink supply source, wherein each printhead segment carrier includes at least one ink gallery arranged so as to connect the or an associated one of said ink supply channels with an ink inlet of the at least one printhead segment mounted to that printhead segment carrier.

50. An inkjet printhead assembly according to claim 49, further including a shim extending at least partway along the slot, a first side of said shim abutting said sidewall sections and said internal webs and said printhead segment carriers abutting a second side of said shim, and wherein each said ink gallery is in fluid communication with the or one said ink supply channel via an opening in said shim.

51. An inkjet printhead assembly according to claim 50, further including first and second end caps sealingly secured to respective terminal ends of said elongate member, each cap having a formation abutting said shim.

* * * * *